US007200964B2

(12) United States Patent
Gates

(10) Patent No.: US 7,200,964 B2
(45) Date of Patent: Apr. 10, 2007

(54) FIREARM CARTRIDGE CLIP

(76) Inventor: Craig D. Gates, 10412 N. Rickel La., Mead, WA (US) 99021-7710

( * ) Notice: Subject to any disclaimer, the term of this patent is extended or adjusted under 35 U.S.C. 154(b) by 47 days.

(21) Appl. No.: 10/778,425

(22) Filed: Feb. 12, 2004

(65) Prior Publication Data

US 2005/0188579 A1 Sep. 1, 2005

(51) Int. Cl.
*F41A 9/61* (2006.01)

(52) U.S. Cl. ..... 42/50; 42/49.01; 89/197

(58) Field of Classification Search ..... 42/50, 42/49.1, 49.01, 7, 87, 22, 18; 89/197, 195
See application file for complete search history.

(56) References Cited

U.S. PATENT DOCUMENTS

| | | | | | |
|---|---|---|---|---|---|
| 1,245,499 | A | * | 11/1917 | Orme | 42/7 |
| 1,299,303 | A | * | 4/1919 | Cowles | 42/50 |
| 1,307,492 | A | * | 6/1919 | Hammond | 42/7 |
| 1,351,370 | A | * | 8/1920 | Chase | 42/7 |
| 1,400,252 | A | * | 12/1921 | Weed | 42/18 |
| 1,500,580 | A | * | 7/1924 | Matteo | 42/50 |
| 1,797,951 | A | * | 3/1931 | Gaidos | 42/50 |
| 2,137,491 | A | * | 11/1938 | Huff | 42/90 |
| 2,441,735 | A | * | 5/1948 | Warner | 42/50 |
| 2,514,277 | A | * | 7/1950 | Donnallan | 42/106 |
| 2,620,582 | A | | 12/1952 | Stukas | 42/50 |
| 2,862,324 | A | | 12/1958 | Ball | 42/50 |
| 2,885,811 | A | * | 5/1959 | Womble, Jr. | 42/50 |
| 3,345,770 | A | * | 10/1967 | Scanlon, Jr. | 42/18 |
| 3,509,655 | A | | 5/1970 | Wilhelm | 42/50 |
| 4,079,535 | A | * | 3/1978 | Elbe et al. | 42/49.02 |
| 4,219,953 | A | * | 9/1980 | Musgrave | 42/1.02 |
| 4,329,802 | A | * | 5/1982 | Coonan | 42/50 |
| 4,430,821 | A | * | 2/1984 | Vincent | 42/50 |
| 4,514,922 | A | | 5/1985 | Farrar et al. | 42/50 |
| 4,516,346 | A | | 5/1985 | Farrar et al. | 42/50 |
| 4,614,052 | A | | 9/1986 | Brown et al. | 42/87 |
| 4,831,761 | A | * | 5/1989 | Kulakow | 42/50 |
| 4,995,179 | A | * | 2/1991 | Switzer | 42/50 |
| 5,081,778 | A | * | 1/1992 | Switzer | 42/50 |
| 5,113,605 | A | * | 5/1992 | Kim | 42/50 |
| 5,129,173 | A | | 7/1992 | Kuykendall | 42/90 |
| 5,291,679 | A | * | 3/1994 | Wollack et al. | 42/50 |
| 5,309,660 | A | * | 5/1994 | Blackamore | 42/50 |
| 5,495,687 | A | * | 3/1996 | Waiser | 42/50 |
| 5,592,769 | A | * | 1/1997 | Villani | 42/1.02 |
| 5,615,505 | A | * | 4/1997 | Vaid | 42/50 |
| 5,651,204 | A | * | 7/1997 | Hulsey et al. | 42/50 |
| 6,094,850 | A | * | 8/2000 | Villani | 42/1.02 |
| 2003/0066227 | A1 | * | 4/2003 | Fitzpatrick | 42/50 |

* cited by examiner

*Primary Examiner*—J. Woodrow Eldred

(57) ABSTRACT

A preferred embodiment of a firearm cartridge clip is disclosed, in which the clip has an elongated housing extending from an open top end to an enclosed bottom end defining an elongated cartridge storage chamber. The clip has a cartridge support seat mounted in the chamber above a separate elevator element. A chamber compression spring is mounted in the chamber between a base at the bottom end and the elevator element to urge the elevator element upward. A separate movement-restraining means is associated with the cartridge support seat to resist downward movement of the seat from the opening at the top end. The clip has a loading facilitating means for selectively rendering the compression spring ineffective to urge the seat upward to thereby reduce the manual effort required to load the clip.

32 Claims, 17 Drawing Sheets

27

FIREARM CARTRIDGE CLIP

TECHNICAL FIELD

This invention relates to firearm cartridge clips having features that facilitate the loading of cartridge shells into the clips.

BACKGROUND OF THE INVENTION

Traditional firearm cartridge clips require that the cartridge shells be manually loaded one at a time through an upper opening into the clip overcoming the progressively increasing resistance of a clip spring. Generally, each cartridge shell, as it is being loaded, is pressed against a previously loaded shell requiring considerable finger dexterity and strength. Many people do not have the prerequisite finger strength or dexterity to manually load a firearm cartridge clip. Others are only able to partially load the clips, as the dexterity and strength required to fully load the clip exceeds their capabilities. Furthermore, resistance of the clip spring can slow the speed with which a clip is loaded, as well as tire an individual that has to load multiple clips.

Many attempts have been made to provide clips or devices that are used with clips to facilitate the loading of the cartridge shells into the clips. Some of the modified clips or devices withdraw the cartridge support seat from the clip opening by drawing down the clip spring to reduce the loading resistance. Such modified clips or devices, although reducing the loading resistance, increase the likelihood that the cartridge shells will fall into the clip in a vertical or diagonal orientation, requiring that the clip be emptied and reloaded. A number of such modified clips are described in patents that are classified in U.S. Class 42, subclass 50.

One of the principal objects and advantages of the present invention is to overcome the disadvantages of much of the prior art clips and provide a rather simple and easy-to-use clip that materially facilitates the loading of the firearm cartridge clip.

These and other objects and advantages of the present invention will become apparent upon reading the following description in conjunction with the drawings.

SUMMARY OF THE INVENTION

A firearm clip cartridge is provided with a structure that reduces spring force acting on a cartridge support seat when loading cartridge shells into a housing of the firearm clip cartridge. By reducing force on the seat, cartridge shells can be loaded into the cartridge with greater ease, accuracy, and efficiency.

According to one aspect, a firearm cartridge clip is provided which includes a housing, a cartridge support seat, a spring, and a spring force-reducing structure. The housing has a chamber with a top end, a bottom end, and an opening at the top end. The chamber is configured to store a sequential array of cartridge shells and the opening configured for loading shells and feeding shells to a firearm. The cartridge support seat is carried for movement in the chamber along a central axis of the housing. A spring provided between the cartridge support seat and the bottom end of the chamber is configured to urge the cartridge support seat toward the opening. A spring force-reducing structure is provided between the seat and the housing and is configured to reduce urging of the seat by the spring toward the opening.

According to another aspect, a firearm cartridge clip is provided for receiving and storing a plurality of cartridge shells and for sequentially feeding such loaded cartridge shells to a breech of a firearm when a loaded cartridge clip is attached to the firearm, and includes a cartridge clip housing, a cartridge support seat, an elevator element, a chamber compression spring, and loading facilitating means. The cartridge clip housing has a cartridge shell storage chamber formed therein extending longitudinally along a general housing axis between a bottom end and a top end, said top end having an opening through which the cartridge shells are (1) sequentially manually loaded into the storage chamber for storage, and (2) sequentially fed from the storage chamber into the firearm when the firearm cartridge clip is attached to the firearm. The cartridge support seat is movably mounted in the storage chamber for (1) supporting the cartridge shells stacked one on top of another within the storage chamber substantially transverse to the housing axis, and (2) moving the cartridges along the housing axis. The elevator element, separate from the cartridge support seat, is movably mounted in the storage chamber intermediate the cartridge support seat and the bottom end for movement along the housing axis. The chamber compression spring is mounted in the housing chamber intermediate the elevator element and the bottom end. The chamber compression spring has a known spring rate and an initial compression for normally urging the elevator element and the cartridge support seat toward the top end to sequentially feed cartridge shells to the top end opening. The loading facilitating means is operatively connected to the chamber compression spring for selectively rendering the compression control spring at least partially ineffective to reduce the urging of the cartridge support seat toward the top end and thereby reduce the manual effort required to load the cartridge shells through the top opening and into the housing chamber.

According to yet another aspect, a firearm cartridge clip is provided for receiving a plurality of cartridge shells and for sequentially feeding such loaded cartridge shells to a breech of a firearm when a loaded cartridge clip is attached to the firearm, and includes a cartridge clip housing, a cartridge support seat, an elevator element, a first chamber compression spring, a second chamber compression spring, and a loading facilitating means. The cartridge clip housing has a cartridge shell storage chamber formed therein extending longitudinally along a general housing axis between a bottom end and a top end, said top end having an opening through which the cartridge shells are (1) sequentially loaded into the storage chamber for storage, and (2) sequentially fed from the storage chamber into the firearm when the firearm cartridge clip is attached to the firearm. The cartridge support seat is movably mounted in the storage chamber for (1) supporting the cartridge shells stacked one on top of another within the storage chamber substantially transverse to the housing axis, and (2) moving the cartridges along the housing axis. The elevator element is movably mounted in the storage chamber intermediate the cartridge support seat and the bottom end for movement along the housing axis. The first chamber compression spring is mounted in the housing chamber intermediate the elevator element and the bottom end. The first chamber compression spring has a known spring rate and an initial compression for normally urging the elevator element and the cartridge support seat toward the top end to feed cartridge shells from the top opening. The second chamber compression spring is mounted in the housing chamber intermediate the cartridge support seat and the elevator element. The second chamber compression spring has a known spring rate and an initial compression for urging the cartridge support seat toward the top end. The loading facilitating means is operatively connected to the elevator element for selectively lowering the elevator means toward the bottom end to reduce the urging of the cartridge support shell toward the top end and thereby selectively reducing the effort required to load the cartridge shells through the top opening and into the housing chamber.

According to even yet another aspect, a firearm cartridge clip is provided for receiving a plurality of cartridge shells and for sequentially feeding such loaded cartridge shells to a breech of a firearm when a loaded cartridge clip is attached to the firearm, and includes a cartridge clip housing, a cartridge support seat, an elevator element, a chamber compression spring, a movement restraining compression spring, and a loading facilitating means. The cartridge clip housing has a cartridge shell storage chamber formed therein extending longitudinally along a general housing axis between a bottom end and a top end, said top end having an opening through which the cartridge shells are (1) sequentially manually loaded into the storage chamber for storage, and (2) sequentially fed from the storage chamber into the firearm when the firearm cartridge clip is attached to the firearm. The cartridge support seat is movably mounted in the storage chamber for (1) supporting the cartridge shells stacked one on top of another within the storage chamber substantially transverse to the housing axis, and (2) moving the cartridges along the housing axis. The elevator element is movably mounted in the storage chamber intermediate the cartridge support seat and the bottom end for movement along the housing axis. The chamber compression spring is mounted in the housing chamber intermediate the elevator element and the bottom end. The chamber compression spring has an initial compression for normally urging the elevator element and the cartridge support seat toward the top end to feed cartridge shells from the top opening. The movement-restraining compression spring is mounted in the housing chamber intermediate the cartridge support seat and the elevator element. The movement-restraining compression spring has an initial compression for urging the cartridge support seat toward the top end. The loading facilitating means is operatively connected to the elevator element for selectively lowering the elevator means toward the bottom end to reduce the initial compression of the movement restraining compression spring and the urging of the cartridge support seat toward the top end and thereby selectively reducing the manual effort required to load the cartridge shells through the top opening and into the housing chamber.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
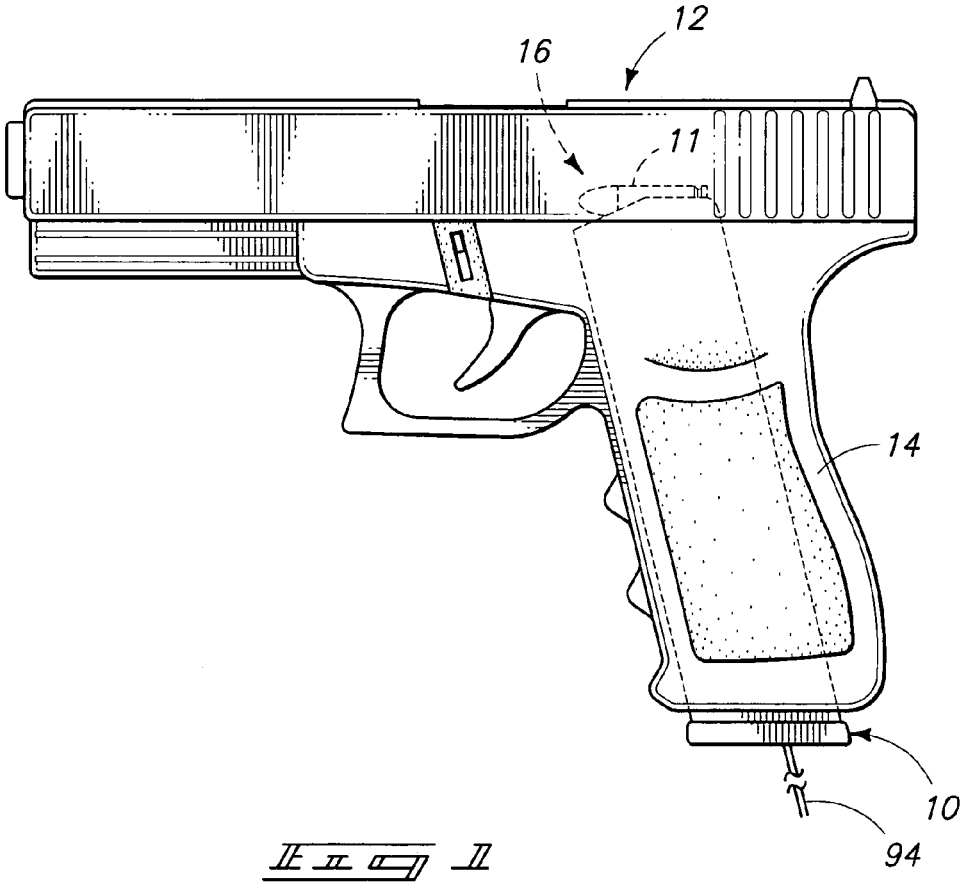
FIG. 1 is a side view of a firearm, in the form of a handgun, illustrating a preferred embodiment of a firearm cartridge clip mounted therein for feeding cartridge shells into a breech of the firearm.
Figure 2:
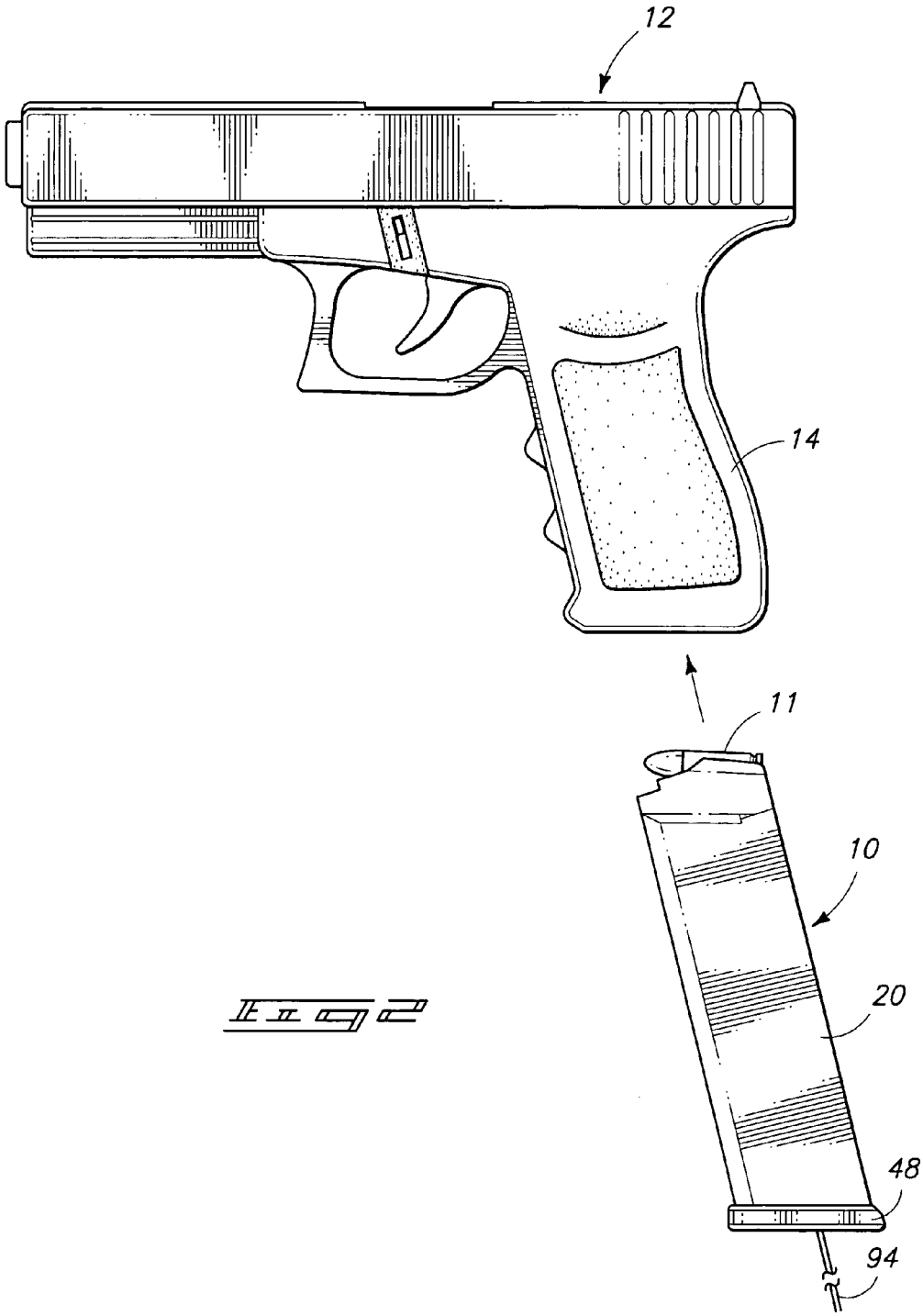
FIG. 2 is a side view similar to FIG. 1, illustrating the firearm cartridge clip as it is being inserted into a handle of the firearm.
Figure 3:
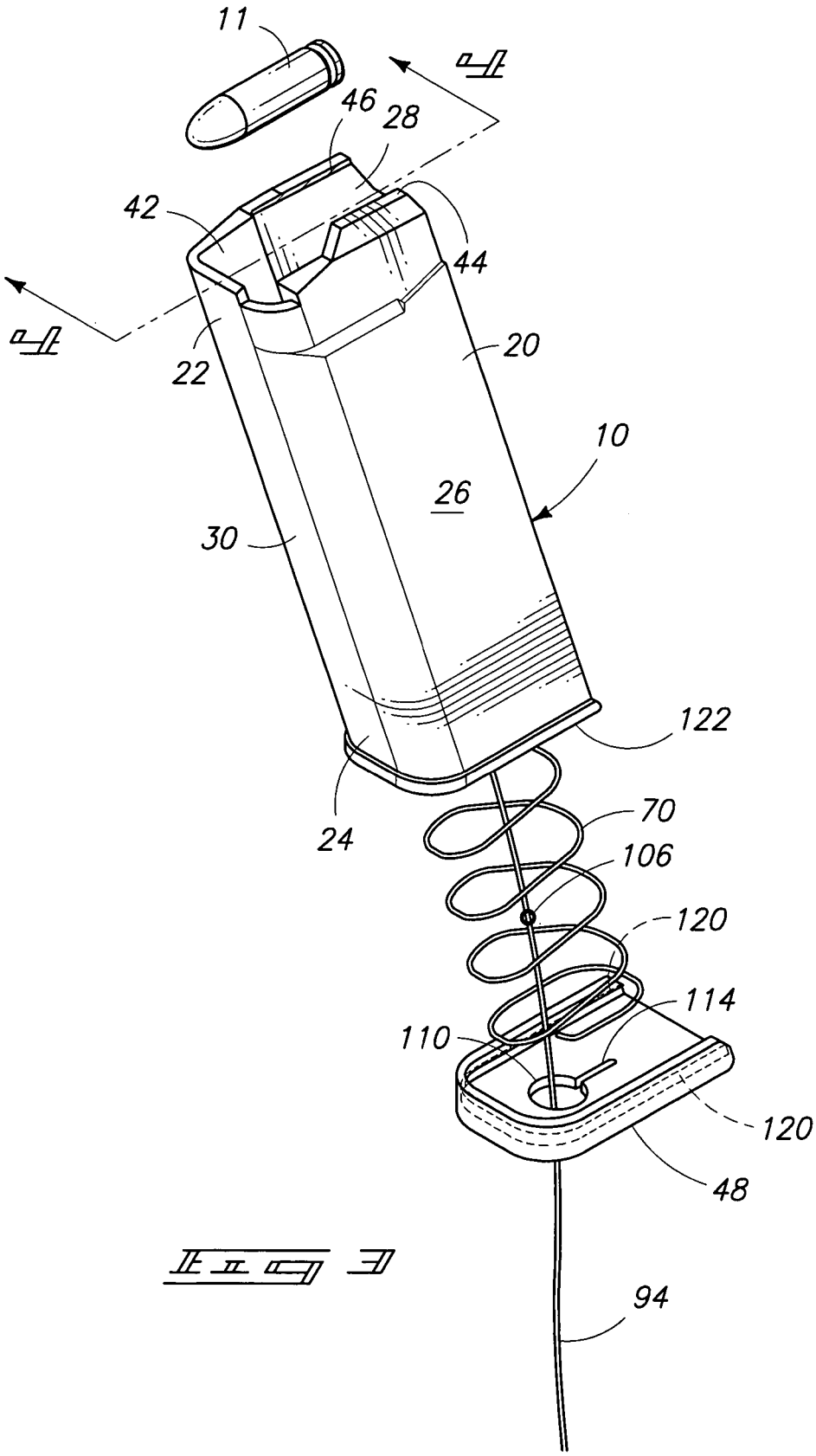
FIG. 3 is an exploded perspective view of the firearm cartridge clip shown in FIG. 1.

Referring now to the drawings, there is shown in FIGS. 1 and 2 a preferred embodiment firearm cartridge clip 10. The firearm cartridge clip 10 is designed to receive and store a plurality of firearm cartridge shells 11 therein. The firearm cartridge clip 10 is adapted to be mounted or attached to a clip receiving structure, such as a handle 14, of a firearm 12. The clip 10 is intend to sequentially feed the firearm cartridge shells 11 into a breech 16 of the firearm 12. When the clip 10 becomes empty, it is generally ejected from the firearm by a release latch (not shown) and a full clip 10 mounted in its place. The empty clip 10 is then manually loaded with unspent cartridge shells, one at a time, until the clip 10 contains the desired number or maximum number of cartridge shells 11. Generally, the firearm user will carry a desired number of full clips 10 for replacing spent or empty clips 10 as they become used.

FIGS. 3–9 illustrate a preferred firearm cartridge clip 10. The clip 10 has an elongated cartridge clip housing 20 that extends along a housing axis 34 from an upper or top end 22 to a lower or bottom end 24. The housing 20 has elongated side walls 26, 28, 30 and 32 that extend between the ends 22 and 24 along the axis 34, enclosing and forming an elongated cartridge shell storage chamber 36. The upper end 22 has a cartridge shell opening or mouth 42 through which the cartridge shells 11 pass. The housing 20 at the opening 42 has opposing side flanges 44 and 46 to provide a limited stop to hold the cartridge shells 11 within the chamber 36. A base or plate 48 is provided at the bottom end 24 to enclose the chamber 36.

Figures 4, 5:
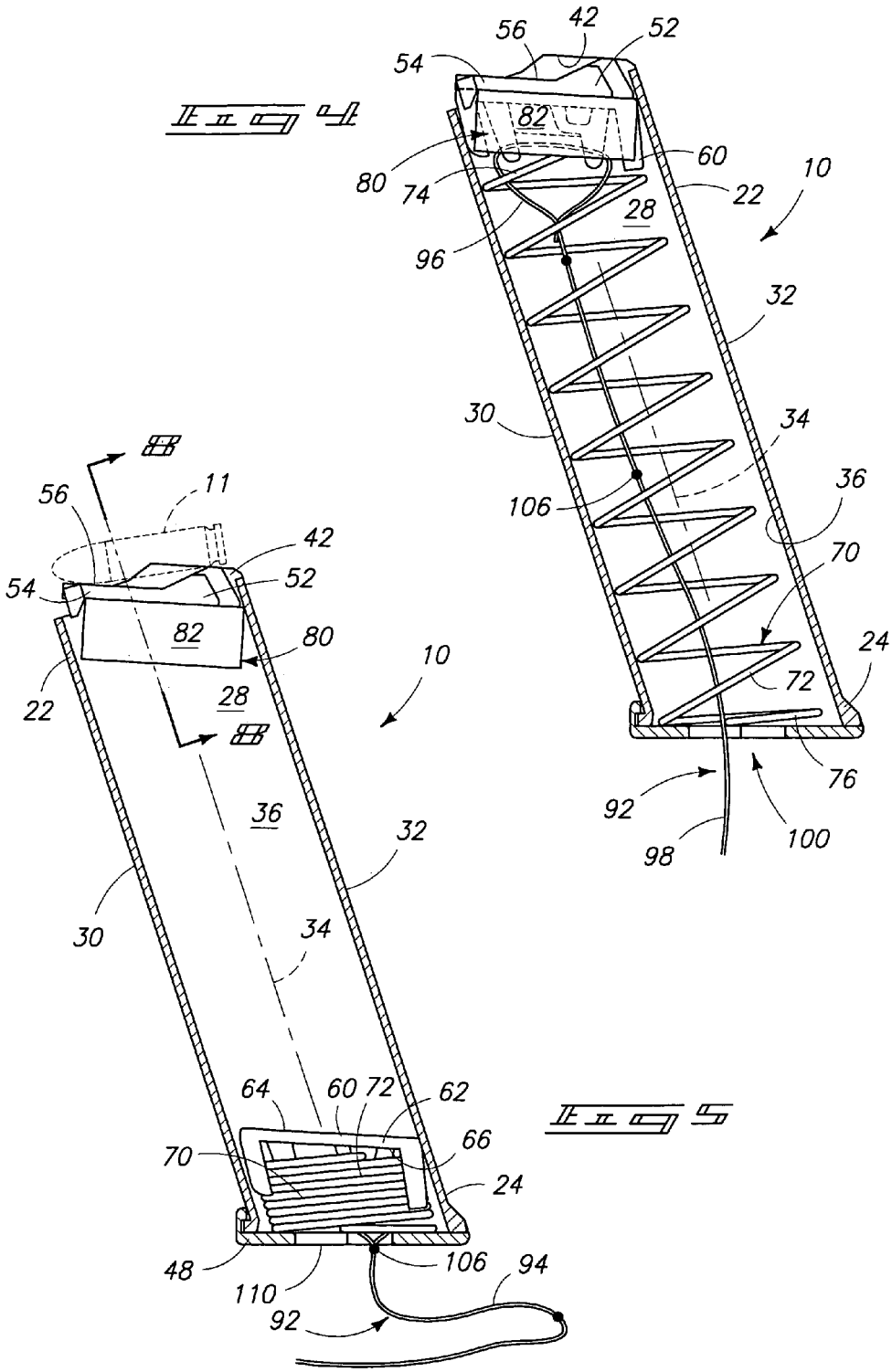
FIG. 4 is a vertical cross-sectional view taken along line 4—4 in FIG. 3 illustrating the interior of the clip when it is empty with a cartridge support seat and elevator element in uppermost positions and a chamber compression spring in its fully extended compressed position.
FIG. 5 is a vertical cross-sectional view similar to FIG. 4, except showing the interior of the clip in which the cartridge support seat remains in its uppermost position and the elevator element and the chamber compression spring are drawn to the lower end to facilitate loading of cartridge shells.

The clip 10 has a cartridge support seat 52 mounted in the chamber 36 for vertical movement along the axis 34, as shown in FIG. 4. The seat 52 has an elongated body 54 with un upper support surface 56 for engaging and supporting a cartridge shell 11 within the chamber 36.

The clip 10 has an elevator element 60, separate from the cartridge support seat 52, mounted in the chamber 36 intermediate the seat 52 and the base 48 for vertical or floating movement along the axis 34. The elevator element 60 has an elongated body 62 with an upper surface 64 and a lower surface 66.

Clip 10 has a chamber compression spring 70 mounted in the chamber 36 between the elevator element 60 and the base 48 for normally urging the elevator element 60 and the seat 52 upward to help feed the stored cartridge shells 11 through the opening 42. The chamber compression spring 70 has a known spring rate. When mounted in the chamber 36, the chamber compression spring 70 has a preset initial compression to urge the elevator element 60 and the seat 52 upward.

The chamber compression spring 70 has a plurality of coils 72 that extend from an upper end 74 to a lower end 76. The upper end 74 engages or is fastened to the bottom surface 66 of the elevator element 60 and the lower end 76 engages or is fastened to the bottom base 48. In a preferred embodiment, a majority of the coils 72 are elliptical or somewhat rectangular when viewed perpendicular to the housing axis 34 (see FIG. 3).

Clip 10 has a movement restraining means, generally designated with the reference numeral 80 that is associated with the cartridge support seat 52 for resisting downward movement of the cartridge support seat 52. In the embodiment shown in FIGS. 3–9, the movement restraining means 80 comprises side leaf springs 82 and 84 (see FIG. 8) that are affixed to or attached to corresponding opposite sides of the elongated body 54 of the cartridge support seat 52. The leaf springs 82 and 84 extend outward having corresponding friction surfaces that engage and rub against opposite side walls 26 and 28. The engagement of the friction surfaces with the side walls 26 and 28 resists vertical movement of the cartridge support seat 52 within the cartridge shell storage chamber 36.

Clip 10 further includes a loading facilitating means 92 that is operatively connected to the chamber compression spring 70 to selectively render the chamber compression spring 70, at least partially, ineffective in urging the elevator element 60 and the cartridge support seat 52 upward. When the loading facilitating means 92 is activated, the upward force against the cartridge support seat 52 is reduced to facilitate manual loading of cartridge shells through the opening 42 and into the cartridge shell storage chamber. Once the loading facilitating means 92 is deactivated, the chamber compression spring 70 is rendered effective to urge the elevator means 60 and the cartridge support seat 52 upward to feed the stored cartridge shells sequentially into the breech 16 of the firearm 12.

In the embodiment illustrated in FIGS. 3–9, the loading facilitating means 92 includes a lowering means in the form of a cable 94, such as a wire rope or synthetic rope, having an upper end 96 and a lower end 98. The upper end 96 extends upward in the cartridge shell storage chamber 36 along the housing axis 34 and is attached to the bottom surface 66 of the elevator element 60. The lower end 98 of the cable 94 extends downward through the bottom base 48 to the exterior of the clip 10 to form a handle that may be manually grasped.

The loading facilitating means 92 includes releasable locking means 100 for assisting in the activation and deactivation of the loading facilitating means 92. In the embodiment illustrated in FIGS. 3–7, the releasable locking means 100 includes a cable knot or enlargement 106 and a keyhole aperture 110 formed in the bottom base 48. The keyhole aperture 110 has a large aperture section 112 that is larger than the diameter of the knot 106 to permit the knot 106 to pass therethrough. The keyhole aperture 110 has a small aperture section 114 in open communication with the large aperture section 112 having a diameter less than the diameter of the knot 106 to prevent the knot 104 from passing therethrough.

Preferably, the bottom base 48 is removable from the housing 20 utilizing side grooves 120 (see FIGS. 3 and 9) that are complementary and slide over side rails 122. The bottom base 48 is slidable substantially transverse to the housing axis 34 to attach and remove the bottom base 48 from the lower end of the housing 20.

Operation of the firearm cartridge clip 10 is illustrated by the sequence views of FIGS. 4–7. FIG. 4 illustrates an empty clip 10 with the locking means 100 being in a release mode with the cable 94 extending through the large aperture 112. In the release mode the cable 94 is slack, permitting the pre-compressed chamber compression spring 70 to expand to urge the elevator element 60 upward into engagement with the cartridge support seat 52. In turn, the elevator element 60 pushes the cartridge support seat 52 upward to its uppermost position to effectively close the opening 42.

In FIG. 5, the lower end 98 of the cable 94 is drawn downward to pull the elevator element 60 downward away from the cartridge support seat 52 and further compress the spring 70. The cable 94 is drawn downward a sufficient distance to move the knot 106 through the large aperture section 112 of the keyhole aperture 110 (see FIG. 9). The cable 94 is then moved rearwardly (to the right, as shown in FIG. 5) to move the cable 94 and the knot 106 into the small aperture section 114 (see FIG. 3) to releasably lock the compression spring 70 in the compressed state. It should be noted that the cartridge support seat 52 is restrained from moving downward by the movement restraining means 80 in the form of the side leaf springs 82 and 84 that frictionally engage the side walls 26 and 28, respectively. A substantial empty volume is created in the cartridge shell storage chamber 36 between the cartridge support seat 52 and the elevator element 60.

Figure 6:
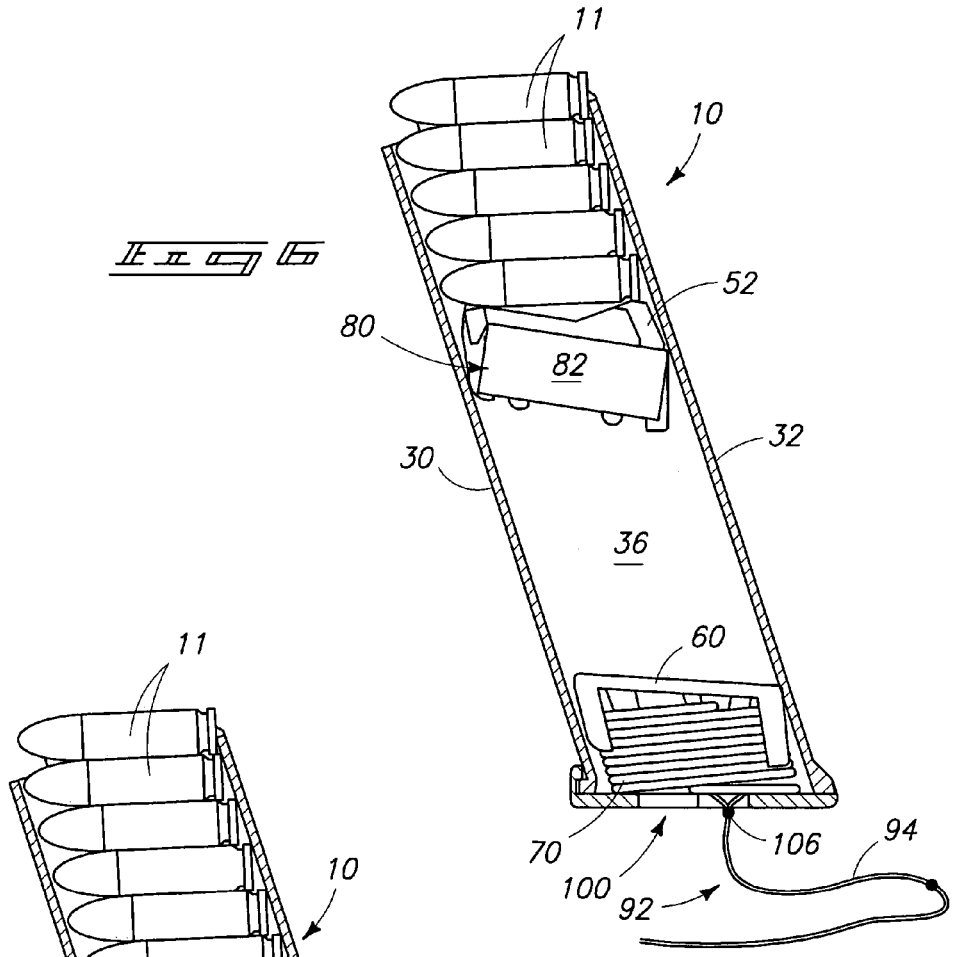
FIG. 6 is a vertical cross-sectional view similar to FIG. 5, except showing cartridge shells being sequentially loaded into the clip incrementally moving the cartridge support seat downward.

In the state shown in FIG. 5, the empty clip 10 has been prepared for loading with live cartridge shells 11. As illustrated in FIG. 6, a number of cartridge shells 11 are forced, one at a time, into and through the opening 42 in a manner that engages a previously inserted shell 11 to sequentially load the clip 10. The cartridge support seat 52 is progressively forced downward, overcoming the resistive force of the friction between the leaf springs 82 and 84 and the side walls 26 and 28. FIG. 6 illustrates the clip 10 being approximately one-half loaded with the cartridge support seat 52 approximately one-half way down in the cartridge storage chamber 36.

Consequently, during the loading cycle, when the upward force of the compression spring 70 is restrained, the force necessary to insert a cartridge shell is dramatically reduced. The downward force necessary to insert a cartridge shell 11 has been reduced to that required to overcome the friction force of the side leaf springs 82 and 84. Such a reduction dramatically increases the efficiency of the manual loading process and reduces the level of manual dexterity required to load the clip. Persons with weak finger muscles are now able to load the clip 10.

Figure 7:
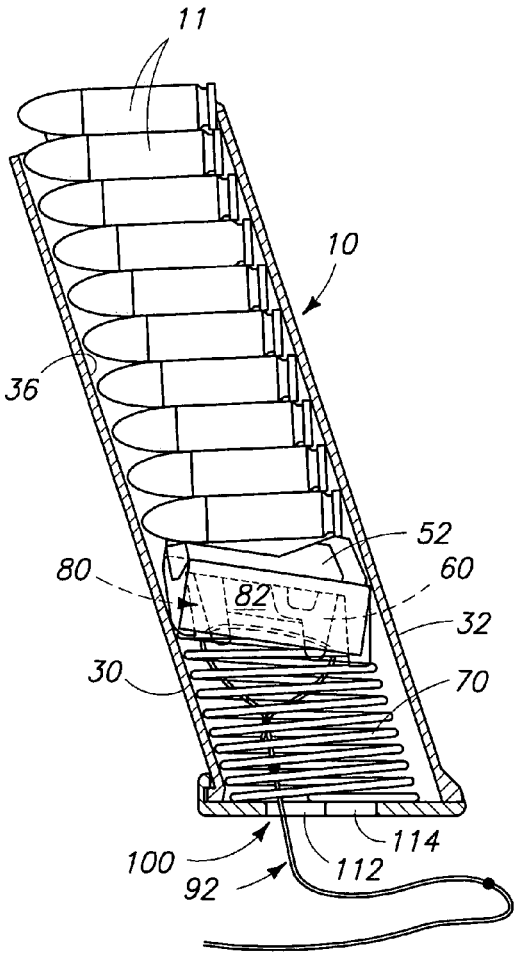
FIG. 7 is a vertical cross-sectional view similar to FIG. 6, except showing the clip full of cartridge shells and the chamber compression spring released to urge the elevator element and cartridge support seat upward.
Figure 8:
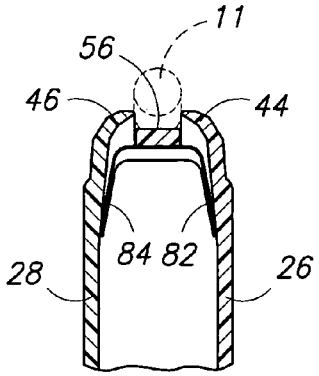
FIG. 8 is a vertical cross-sectional view taken along line 8—8 in FIG. 5 illustrating details of a movement resistance means associated with a cartridge support seat.
Figure 9:
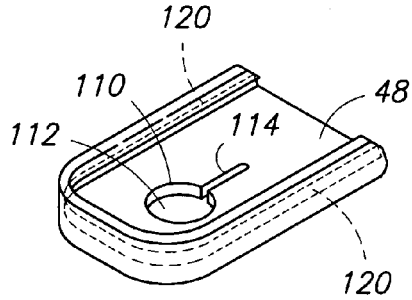
FIG. 9 is a detailed perspective view of a base of the clip, illustrating details of a loading facilitating means.

After the clip 10 has been fully loaded as illustrated in FIG. 7, the locking means 100 is released, allowing the chamber compression spring 70 to expand and urge the elevator element 60 upward against the cartridge support seat 52. Now the loaded clip 10 is ready to be inserted into the firearm 12 with the full spring force necessary to sequentially feed the cartridge shells 11 into breech 16 of the firearm.

An alternate embodiment is illustrated in FIGS. 10–14. Such embodiment features a firearm cartridge clip identified with the reference numeral 210. Clip 210 has an elongated cartridge clip housing 214 that extends along a housing axis 228 from an upper end 216 to a lower end 218. Housing 214 includes an inner member 215 and an outer member 217, having inner and outer telescoping side walls 220 and 221, respectively. The housing 214 extends from a top cartridge opening 222 to a movable base 224 defining an interior telescoping cartridge shell storage chamber 226. When released, base 224 is movable between a feeding position, illustrated in FIG. 10, and a loading position, illustrated in FIG. 11. Base 224 is affixed or attached to the inner side walls 221 to expand the length of the housing 214 when the base 224 is moved to the loading position. Likewise, the interior telescoping cartridge shell storage chamber 226 expands from a feeding volume to a loading volume.

Clip 210 has a cartridge support seat 252 mounted in the cartridge shell storage chamber 226 for vertical movement to and from the opening 222 for supporting cartridge shells 11 stacked one of top of another within the chamber 226. The seat 252 has an elongated body 254 with an upper support surface 256 for engaging a shell 11.

Clip 210 has an elevator element 260, separate from the seat 252, and mounted in the cartridge shell storage chamber 226 between the seat 252 and the base 224 for vertical movement along the housing axis 228. The elevator element 260 has an elongated body 262 with an upper surface 264 and a lower surface 266.

Clip 210 includes a chamber compression spring 270 that is mounted in the cartridge shell storage chamber 226 between the elevator element 260 and the base 224. The chamber compression spring 270 is mounted in the chamber 226 in a pre-compressed condition to urge the elevator element 260 and the seat 252 upward toward the opening 222. The chamber compression spring 226 has spiral coils 272 that extend from an upper end 274 to a lower end 276. Preferably, the coils 274 have a somewhat elliptical or rectangular shape when viewed transverse to the housing axis 228. The upper end 274 engages the lower surface 266 of the elevator element 260 and the lower end 276 bears against the base 224. The chamber compression spring 270 has a known spring rate.

The clip 210 has a movement restraining means generally identified by reference numeral 280 for restraining the downward movement of the seat 252. In this embodiment, the movement restraining means 280 comprises a coil compression spring 282 that is mounted within the chamber 226 between the seat 252 and the elevator element 260 in a pre-compressed condition. The coil compression spring 282 has an upper end 284 that engages the seat 252 and urges the seat 252 upward toward the opening 222. The coil compression spring 282 has a lower end 286 that engages and urges the elevator element 260 downward toward the base 224. The coil compression spring 282 has a known spring rate that is less (weaker) than the spring rate of the chamber compression spring 270 so that spring 282 deflects to a greater degree than chamber compression spring 270.

The clip 210 has a loading facilitating means 292 for facilitating the loading of live cartridge shells 11 into the storage chamber 226. The facilitating means 292 includes a releasable latching means 294 (see FIGS. 15A and 15B) for releasing the base 224 and inner side walls 220 to permit the chamber compression spring 270 to drive the base 224 and the inner side walls 220 from the feeding position, illustrated in FIG. 10, to the loading position, illustrated in FIG. 11, and thereby expand the storage chamber 226.

Figure 15A:
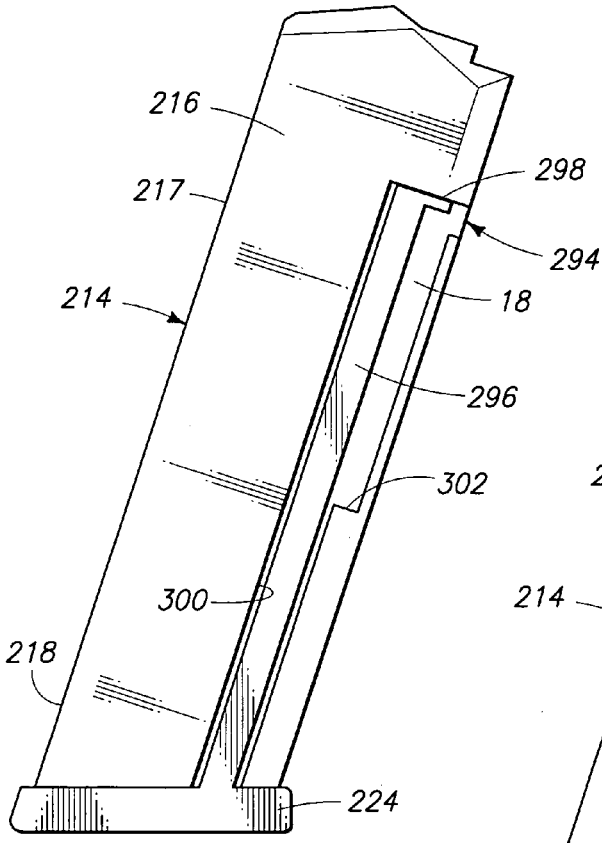
FIG. 15A is an opposite side view of the clip shown in FIGS. 10–14 illustrating details of a latching means for latching the housing in the feeding position.
Figure 15B:
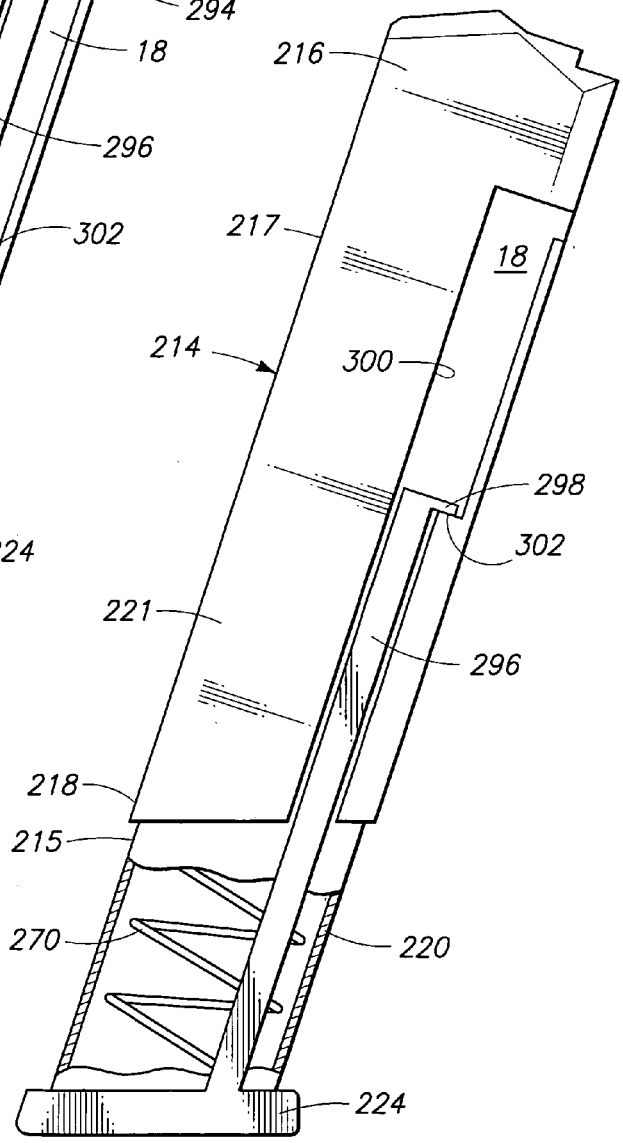
FIG. 15B is an opposite side view similar to FIG. 15A, except showing details of the latching means when the housing is in its extended position.

In this embodiment, the releasable latching means 294 (see FIGS. 15A and 15B). includes a release arm 296 attached to the base 224 that extends upward from the base 224 through an outer wall exterior groove 300 to a hook end 298. The outer wall exterior groove 300 extends upward communicating with a clip release notch 18. The outer wall exterior groove 300 forms a ledge or abutment stop surface 302 adjacent the lower end of the outer wall 221 to engage the hook end 298 and stop the downward movement of the base 224, as illustrated in FIG. 15B.

Figure 10:
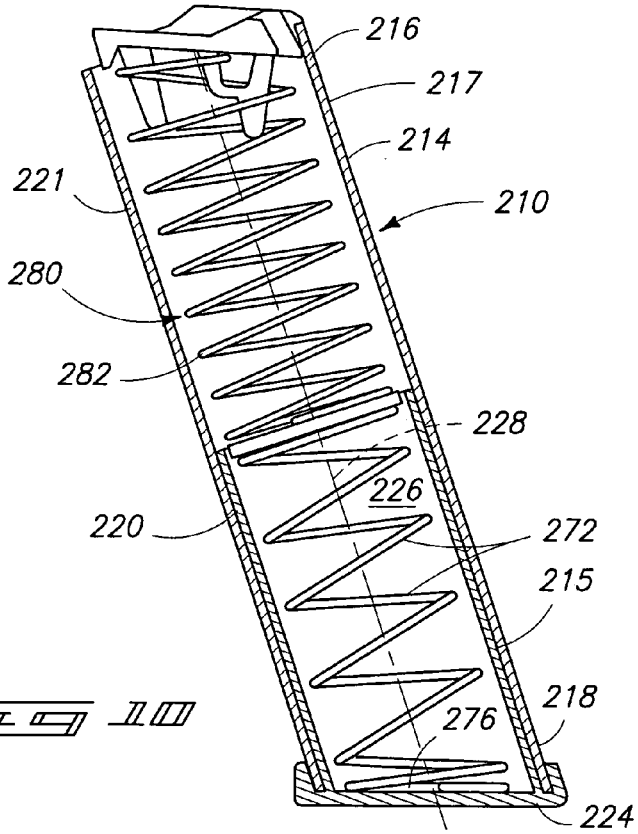
FIG. 10 is a vertical cross-sectional view similar to FIG. 4, except illustrating an alternate embodiment of the clip in which the clip has a telescopic housing in which the housing is shown in its contracted-empty position.

The operation of this embodiment will be described with reference to FIGS. 10–15. FIGS. 10 and 15 illustrate an empty clip 210 that remains in the firearm 12 before it is ejected. The firearm 12 has a clip latch, that is not shown but is common in the industry, that projects into the clip release notch 18 and holds the clip 210 in the firearm 12. In this embodiment, the clip latch also engages the arm hook 298 of the release latching means 294 to hold the base 224 in the feeding position illustrated in FIG. 10.

Figures 11, 12:
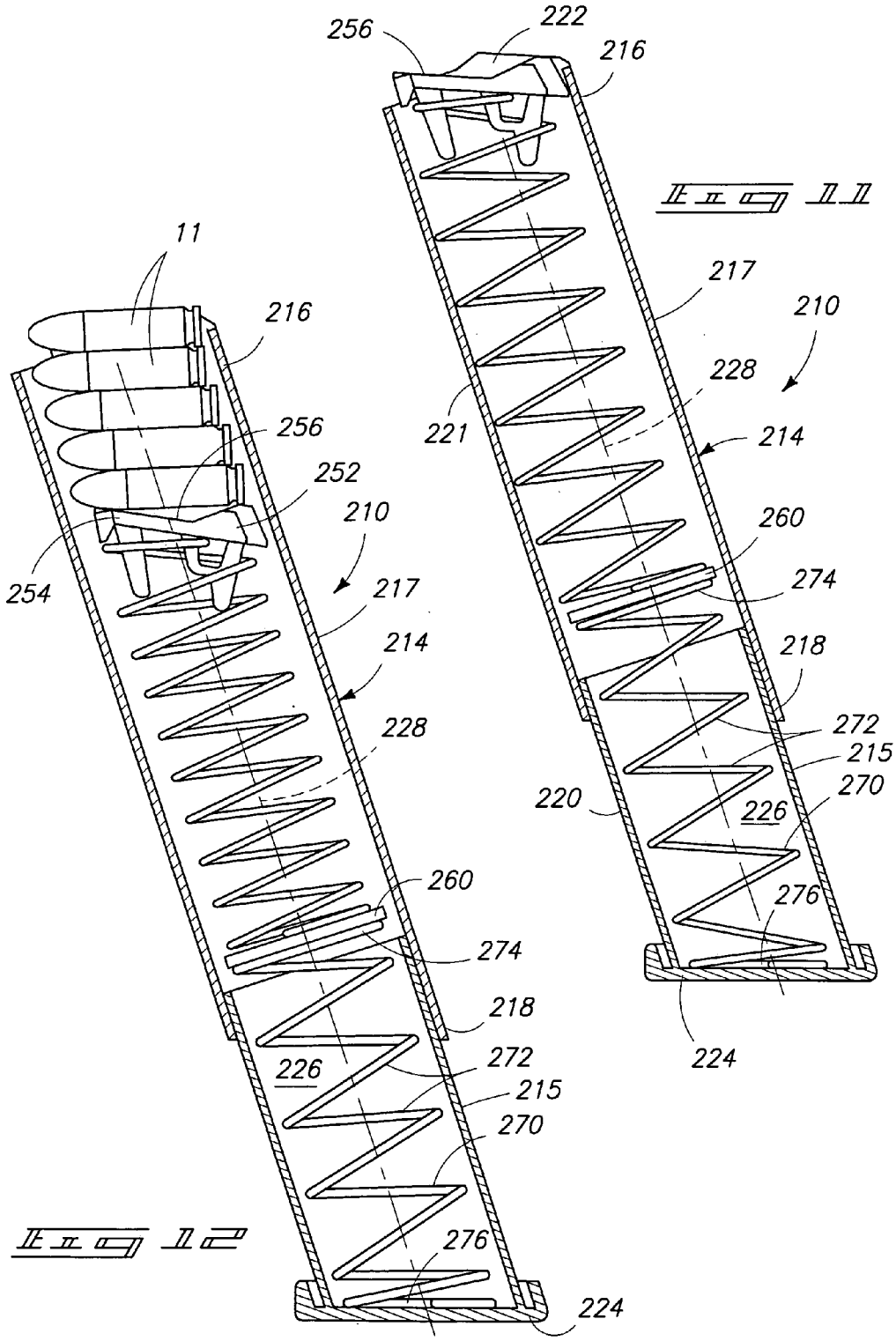
FIG. 11 is a vertical cross-sectional view similar to FIG. 10, except showing the housing in its extended position expanding the chamber compression spring with the cartridge support seat in its uppermost position.
FIG. 12 is a vertical cross-sectional view similar to FIG. 11, except showing cartridge shells being loaded one at a time into the clip incrementally moving the cartridge support seat downward.

Once the firearm latch is removed from the notch 18, the arm hook 298 is disengaged, permitting the chamber compression spring 270 to drive the base 224 and inner side walls 220 downward from the feeding position to the extended loading position illustrated in FIG. 11. The arm hook 298 moves downward in the outer wall exterior groove 300 until it engages the abutment stop surface 302 preventing further downward movement of the base 224. The expansion of the storage chamber 226 substantially reduces the upward pressure of the chamber compression spring 270, causing the elevator element 260 to move downward and thereby substantially reduce the upward pressure of the compression spring 282 against the cartridge shell seat 252.

Figure 13:
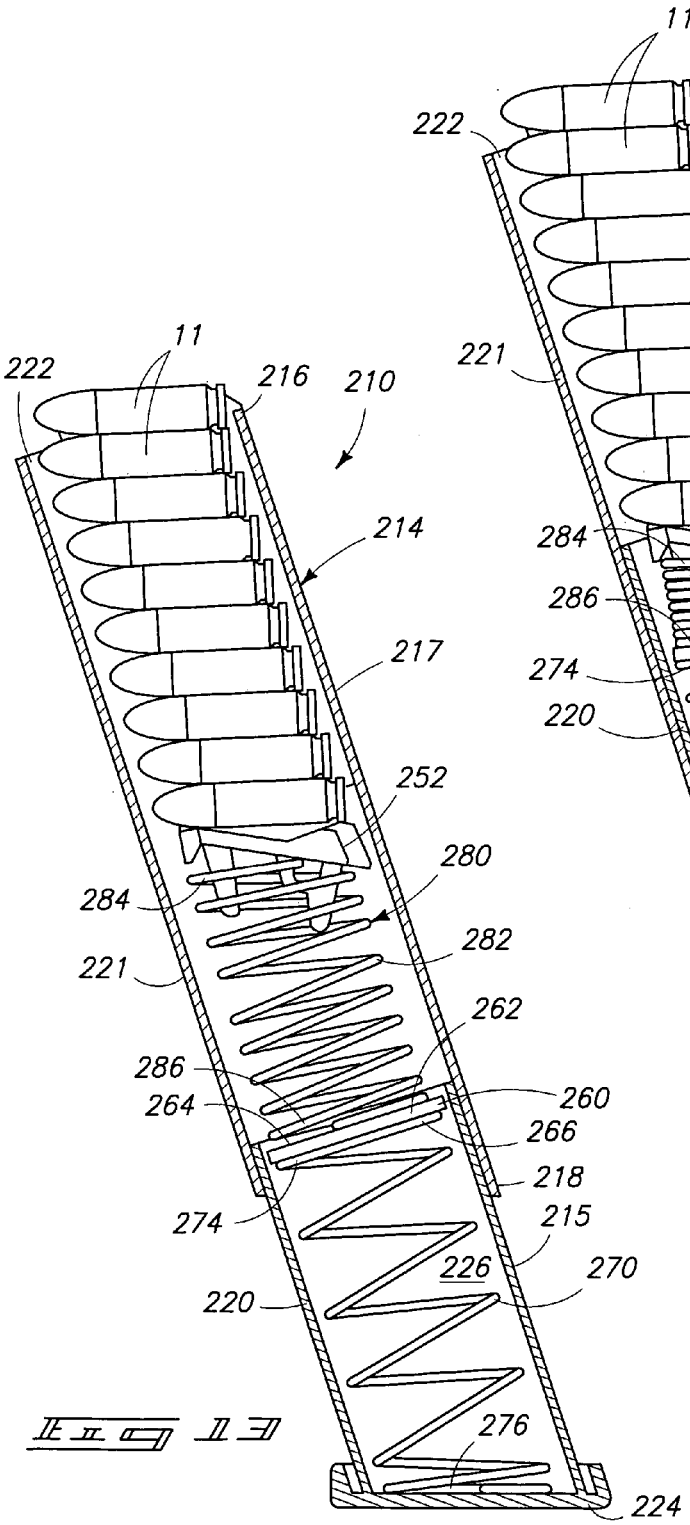
FIG. 13 is a vertical cross-sectional view similar to FIG. 12, except illustrating the clip being approximately one-half full of cartridge shells.

Now the empty clip 210 is ready for loading. FIG. 12 illustrates the partial loading of cartridge shells 11 through the opening 222 and into the storage chamber 226 with the cartridge shell seat 252 and elevator element 260 incrementally moving downward at different rates as each shell 11 is manually loaded into the clip 210. FIG. 13 illustrates the loading of a full complement of shells 11 into the storage chamber 226.

Figure 14:
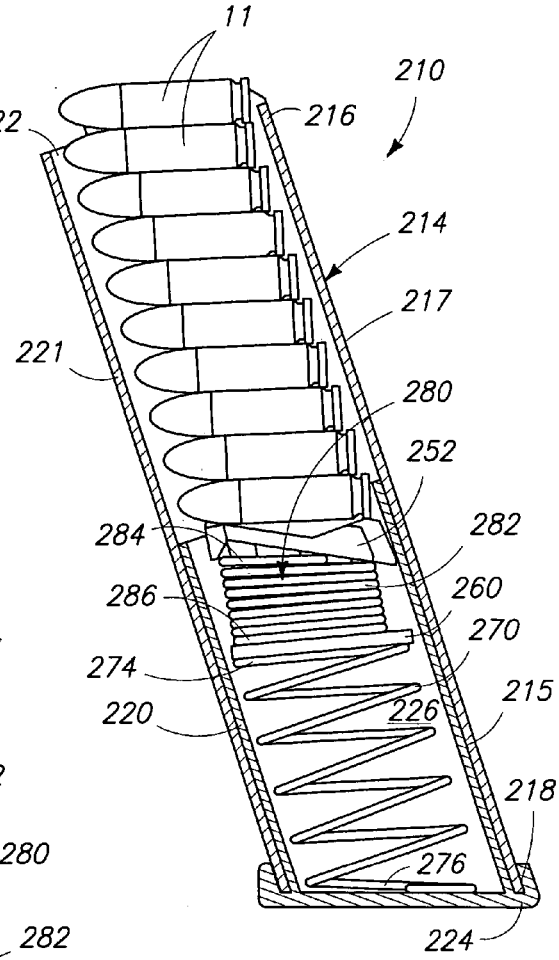
FIG. 14 is a vertical cross-sectional view similar to FIG. 13 showing the clip full of shells and the housing contracted to its feeding position.

Now the clip 210 is ready for insertion into the firearm 12. FIG. 14 shows the full clip 210 with the base 224 moved upward to the feeding position to further compress the chamber compression spring 270 and the coil compression spring 282 and urge the shells 11 into the firearm breech 16. As illustrated in FIG. 15A, the arm hook 298 moves upward in the groove 300 and into the notch 18 to engage the latch of the firearm 12. The latch of the firearm 12 holds the arm hook 298 in the notch 18 and holds the chip 210 in the firearm 12 until it is intentionally ejected.

Figure 16:
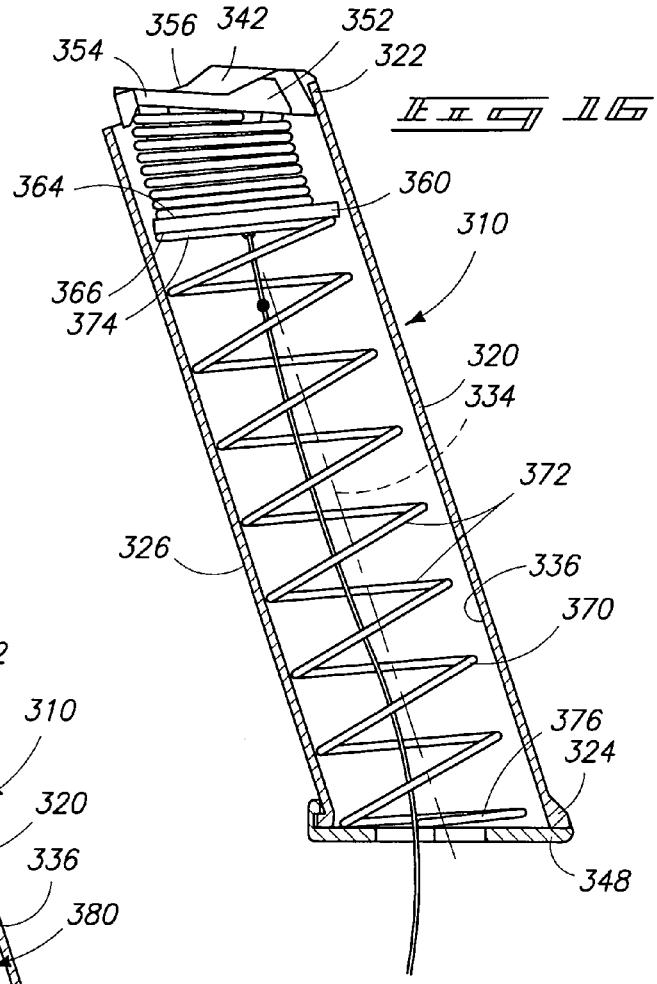
FIG. 16 is a vertical cross-sectional view similar to FIG. 10, except illustrating an alternate embodiment of the clip in which the cartridge support seat and the elevator element are shown in their uppermost positions and the chamber compression spring is in its fully extended compression position.
Figure 17:
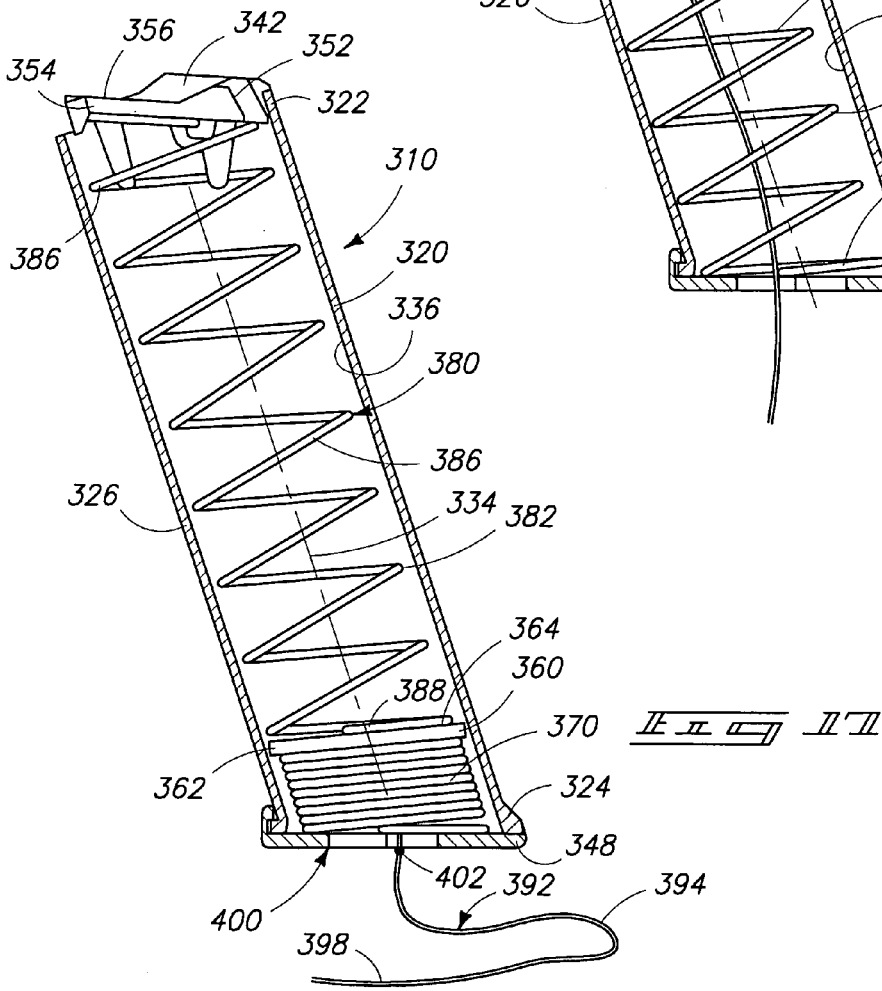
FIG. 17 is a vertical cross-sectional view similar to FIG. 16 in which a loading facilitating means is activated to retract the elevator element and the chamber compression spring toward a lower end.

A further alternate embodiment is illustrated in FIGS. 16–21. FIG. 16 illustrates a firearm cartridge clip 310 having an elongated clip housing 320 having side walls 326 that extend from an upper end 322 to a lower end 324 along a housing axis 334 encompassing and defining a cartridge shell storage chamber 336. The storage chamber 336 extends from an opening 342 at the upper end to a bottom base or plate 348 at the lower end 324.

The clip 310 has a cartridge support seat 352 mounted in the storage chamber 336 for movement along the housing axis 334. The seat 352 has an elongated body 354 with an upper cartridge support surface 356. The clip 310 additionally has an elevator element 360, separate from the seat 352, that is movably mounted in the storage chamber 336 for movement between the seat 352 and the base 348. The elevator element 360 has an elongated body 362 with an upper surface 364 and a lower surface 366.

The clip 310 includes a chamber compression spring 370 mounted in the storage chamber 336 between the elevator element 360 and the base 348. The chamber compression spring 370 has spiral coils 372 extending to an upper end 374 engaging the lower surface 366 of the elevator element 360 and extending to a lower end 376 engaging the base 348. The chamber compression spring 370 has a known spring rate and is mounted in the storage chamber 336 in a pre-compressed condition urging the elevator element 360 upward.

The clip 310 further includes a movement restraining means 380 operatively connected to the cartridge support seat 352 for restraining the downward movement of the support seat 352 in the storage chamber 336. The movement restraining means 380 comprises a coil compression spring 382 having spiral coils 384 extending to an upper end 386 and a lower end 388. The upper end 386 engages the elongated body 354 and urges the support seat 352 upward. The lower end 388 engages the upper surface 364 and urges the elevator means 360 downward. The coil compression spring 382 has a known spring rate that is less (weaker) than the spring rate of the chamber compression spring 370.

The clip 310 has a loading facilitating means 392 for selectively rendering the chamber compression spring 370, at least partially, ineffective to substantially reduce the upward force exerted against the cartridge support seat 352. Such a force reduction materially reduces the physical effort required to sequentially load the clip 310 with cartridge shells.

The loading facilitating means 392 preferably includes an elongated cable 394 having an upper end 396 operatively connected to the elevator element 360. The elongated cable 394 has a lower end 398 that extends through a keyhole aperture 410 formed in the base 348. The loading facilitating means 392 includes an enlargement or knot 402 formed on the cable 394. The keyhole aperture 410 includes a large aperture section 412 having a cross-section larger than that of the knot 402 to allow the knot 402 to pass therethrough. The keyhole aperture 410 also includes a small aperture section 414, in open communication with the large aperture section 412, having a cross-section less than that of the knot 402 to prevent the knot 402 from passing therethrough.

Figure 21:
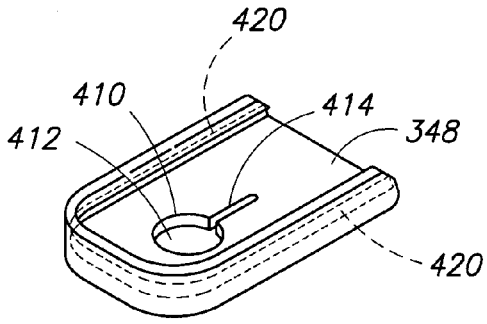
FIG. 21 is a detailed perspective view of the base illustrating details of the loading facilitating means.

As illustrated in FIG. 21, the base 348 may be removable when moved in one direction substantially transverse to the housing axis 334. The base 348 has side grooves 420 formed therein that slide on and are complementary to rails 122 illustrated in FIG. 3.

The process for loading an empty clip 310 is illustrated in FIGS. 16–20. FIG. 16 illustrates an empty clip 310, with the seat 352 and elevator element 310 in their uppermost positions. To facilitate the loading of cartridge shells 11 into the storage chamber 336, the user activates the loading facilitating means 392 by gripping the lower end 398 of the cable 394 and pulling the cable 394 and the knot 402 through the large aperture section 412 of the keyhole aperture 410. Such movement pulls the elevator element 360 downward further compressing the chamber compression spring 370, but more importantly, rendering the chamber compression spring 370 ineffective in exerting an upward force on the cartridge support seat 352. Such an upward force reduction substantially reduces the upward force applied by the compression spring 382 to the seat 352 and thereby materially reducing the physical effort required to load the clip 310 with shells 11.

Figure 18:
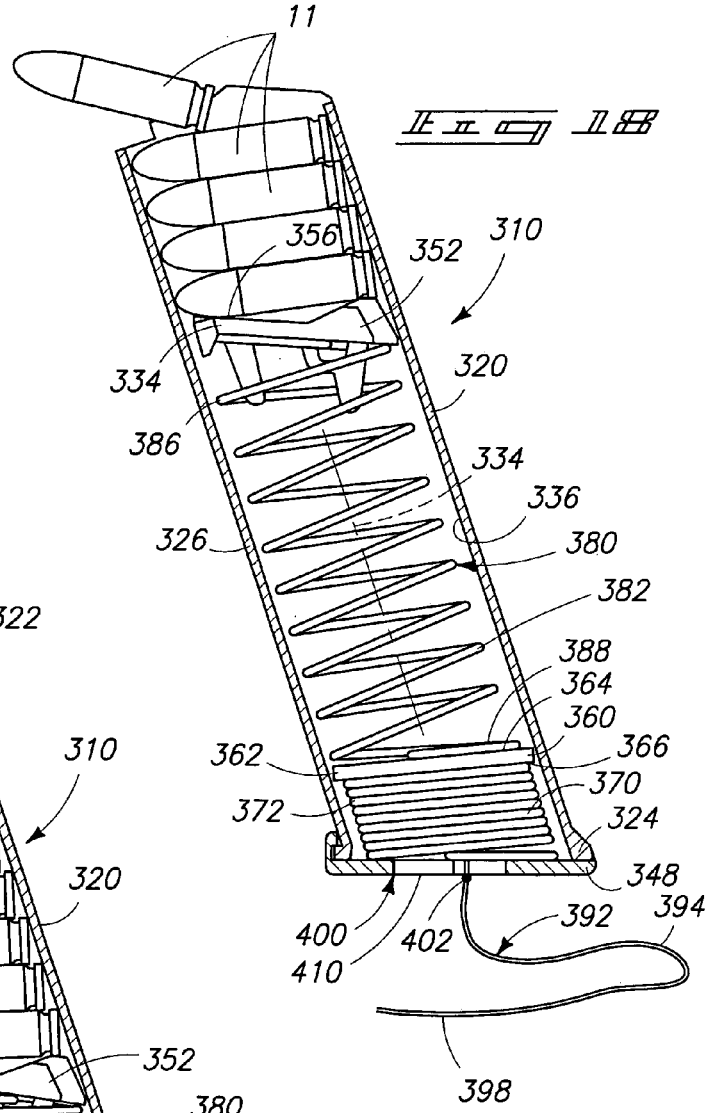
FIG. 18 is a vertical cross-sectional view similar to FIG. 17 illustrating loading of cartridge shells into the clip with the cartridge support seat incrementally moving down as each shell is installed.
Figure 19:
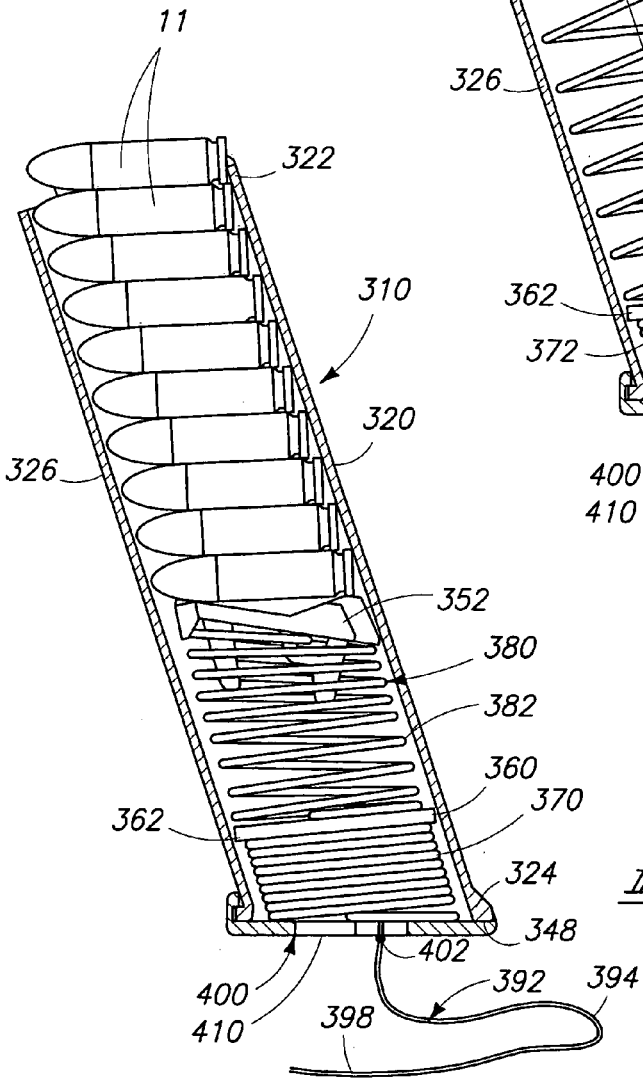
FIG. 19 is a vertical cross-sectional view similar to FIG. 18, except illustrating the loading of a full complement of cartridge shells.
Figure 20:
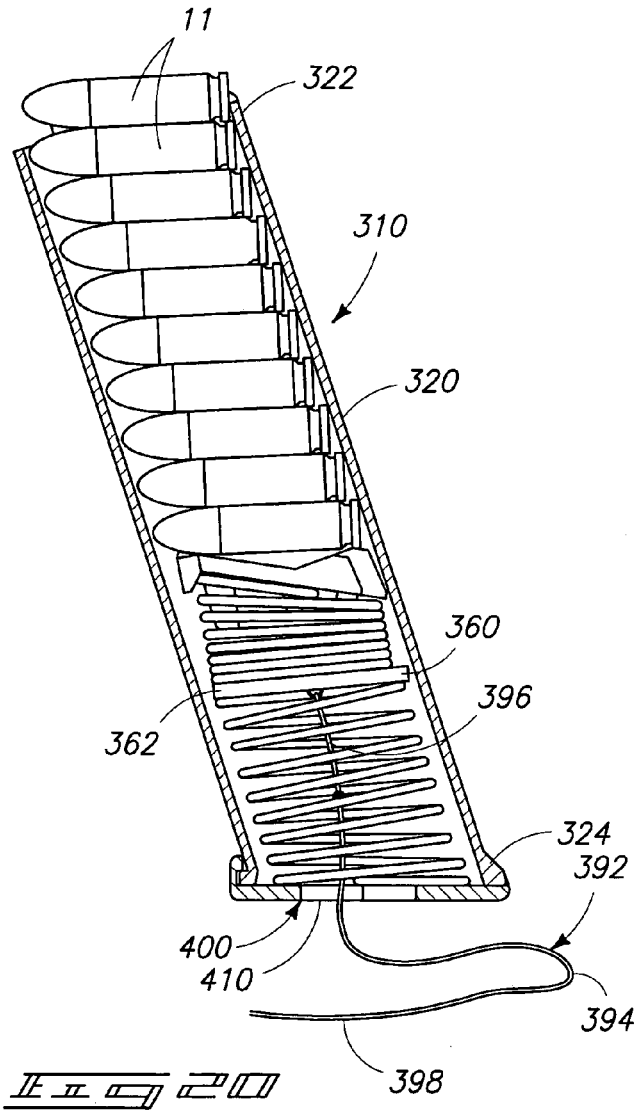
FIG. 20 is a vertical cross-sectional view similar to FIG. 19, except illustrating the deactivation of the loading facilitating means by releasing the elevator element and the chamber compression spring to urge the cartridge shells upward.

After the knot 402 passes through the large aperture section 412, the cable 394 is moved rearwardly to move the cable 394 from the large aperture section 412 into the small aperture section to render effective the releasable locking means 400 to hold the elevator element 360 down. FIG. 18 illustrates the loading of cartridges shells 11 through the opening 342. FIG. 19 shows the clip 310 being fully loaded with cartridge shells 11.

After the clip 310 is fully loaded, the releasable locking means 400 is released to render the chamber compression spring 370 again effective to urge the elevator element 360 and in turn the support seat 352 upward. Specifically, the cable 394 is moved forwardly, moving the knot 402 from the small aperture section 414 to the large aperture section 412 to enable the knot 402 to pass back through the keyhole aperture 410 to render the chamber compression spring 370 effective to push the elevator element 360 upward.

Figure 22:
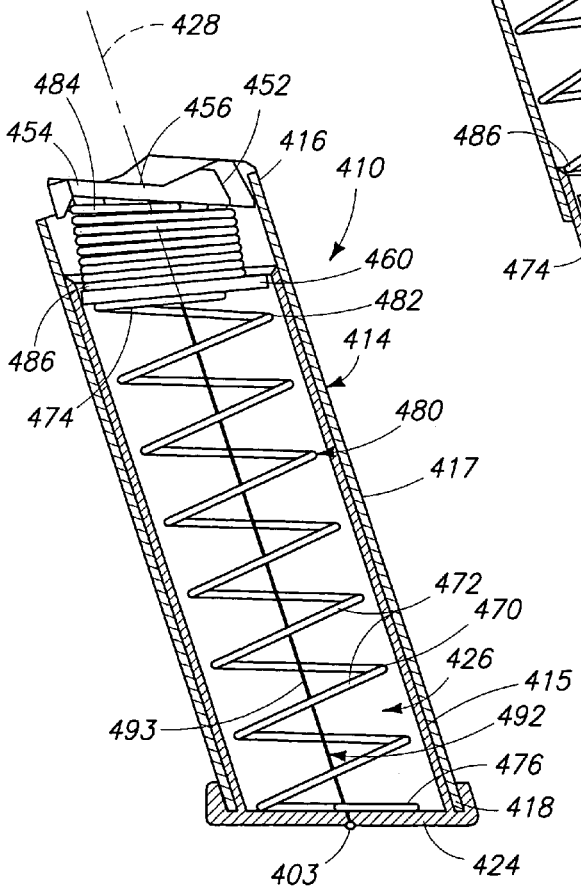
FIG. 22 is a vertical cross-sectional view similar to FIG. 10, except illustrating a further alternative embodiment of the clip in which the clip has a telescopic housing and a fixed lanyard that serves to control free height of the chamber compression spring and in which the housing is shown in its contracted-empty position.
Figure 23:
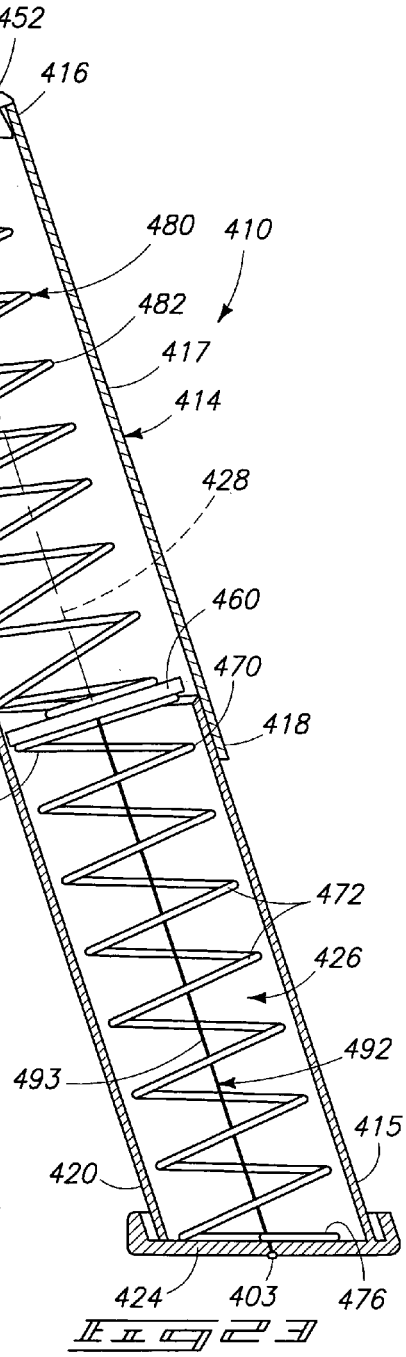
FIG. 23 is a vertical cross-sectional view similar to FIG. 22, except showing the housing in its extended position expanding the chamber compression spring with the cartridge support seat in its uppermost position.
Figure 24:
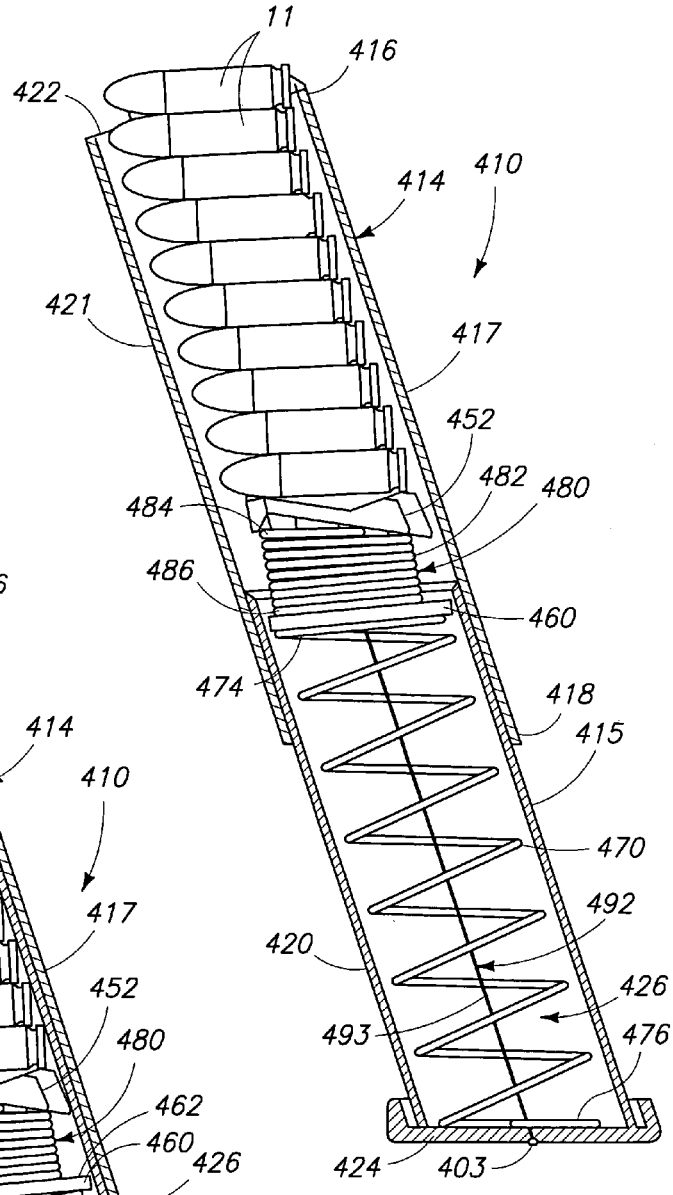
FIG. 24 is a vertical cross-sectional view similar to FIG. 23, except showing cartridge shells being loaded one at a time into the clip incrementally moving the cartridge support seat downward.

FIGS. 22–24 illustrate another embodiment for a cartridge clip 410, similar to the cartridge clip of FIGS. 10–14, and having a telescopic housing 414 including an inner telescoping member 415 and an outer telescoping member 417. Clip 410 has an elongated cartridge clip housing 414 that extends along a housing axis 428 from an upper end 416 to a lower end 418. Inner member 415 and outer member 417 have inner and outer telescoping side walls 420 and 421, respectively. The housing 414 extends from a top cartridge opening 422 to a movable base 424 defining an interior telescoping cartridge shell storage chamber 426. When released, base 424 is movable between a feeding position, illustrated in FIG. 22, and a loading position, illustrated in FIG. 23. Base 424 is integrally formed with the inner side walls 420 to expand the length of the housing 414 when the base 424 is moved to the loading position.

Optionally, base 424 can be constructed from a separate piece that is affixed or fastened to a bottom end of inner side walls 420 of inner telescoping member 415, such as with screws or epoxy adhesive. Likewise, the interior telescoping cartridge shell storage chamber 426 expands from a feeding volume to a loading volume.

Clip 410 has a cartridge support seat 452 mounted in the cartridge shell storage chamber 426 for vertical movement to and from the opening 422 for supporting cartridge shells 11 stacked one of top of another within the chamber 426. The seat 452 has an elongated body 454 with an upper support surface 456 for engaging a shell 11, as shown in FIG. 22.

Clip 410 has an elevator element 460, separate from the seat 452, and mounted in the cartridge shell storage chamber 426 between the seat 452 and the base 424 for vertical movement along the housing axis 428. The elevator element 460 has an elongated body 462 with an upper surface 464 and a lower surface 466 (see FIG. 25).

Clip 410 includes a chamber compression spring 470 that is mounted in the cartridge shell storage chamber 426 between the elevator element 460 and the base 424. The chamber compression spring 470 is mounted in the chamber 426 in a pre-compressed condition to urge the elevator element 460 and the seat 452 upward toward the opening 422. The chamber compression spring 426 has spiral coils 472 that extend from an upper end 474 to a lower end 476. Preferably, the coils 474 have a somewhat elliptical or rectangular shape when viewed transverse to the housing axis 428. The upper end 474 engages the lower surface 466 of the elevator element 460 and the lower end 476 bears against the base 424. The chamber compression spring 470 has a known spring rate.

The clip 410 has a movement restraining means generally identified by reference numeral 480 for restraining the downward movement of the seat 452. In this embodiment, the movement restraining means 480 comprises a coil compression spring 482 that is mounted within the chamber 426 between the seat 452 and the elevator element 460 in a pre-compressed condition. The coil compression spring 482 has an upper end 484 that engages the seat 452 and urges the seat 452 upward toward the opening 422. The coil compression spring 482 has a lower end 486 that engages and urges the elevator element 460 downward toward the base 424. The coil compression spring 482 has a known spring rate that is less (weaker) than the spring rate of the chamber compression spring 470 so that spring 482 deflects to a greater degree than chamber compression spring 470.

The clip 410 has a loading facilitating means 492 for facilitating the loading of live cartridge shells 11 into the storage chamber 426. The facilitating means 492 includes a releasable latching means 294 (see FIGS. 15A and 15B) for releasing the base 424 and inner side walls 420 to permit the chamber compression spring 470 to drive the base 424 and the inner side walls 420 from the feeding position, illustrated in FIG. 22, to the loading position, illustrated in FIG. 23, and thereby expand the storage chamber 426. Load facilitating means 492 also includes a flexible wire cable 493 that limits the extension of spring 470. Alternatively, a rope or cord can be used. Cable 493 serves to limit extension of spring 470 particularly when in the loading position of FIG. 23 which enables extension of spring 482. Extension of spring 482 serves to reduce the loading force needed to compress seat 452 and load shells when housing 414 is in a telescopically extended position.

In this embodiment, the releasable latching means 294 is identical the that disclosed in the embodiment of FIGS. 15A and 15B. Alternatively, the releasable latching means 694 of FIGS. 31–34 can be substituted for releasable latching means 294, as described below in greater detail.

The operation of this embodiment will be described with reference to FIGS. 22–25. FIG. 22 illustrates an empty clip 410 that remains in the firearm 12 before it is ejected. The firearm 12 has a clip latch, as previously described in FIGS. 15A and 15B, that holds the clip 410 in the firearm 12. When the latch is released, the lower member 415 is lowered via springs 470 and 482 to the position shown in FIG. 23.

Now the empty clip 410 is ready for loading, with cable 493 limiting the extension of spring 472, which means that the smaller compressive forces of spring 482 only need to be overcome when loading shells into clip 410. FIG. 23 illustrates the partial loading of cartridge shells 11 through the opening 422 and into the storage chamber 426 with the cartridge shell seat 452 and elevator element 460 incrementally moving downward at different rates as each shell 11 is manually loaded into the clip 410. FIG. 24 illustrates the loading of a full complement of shells 11 into the storage chamber 426.

Figure 25:
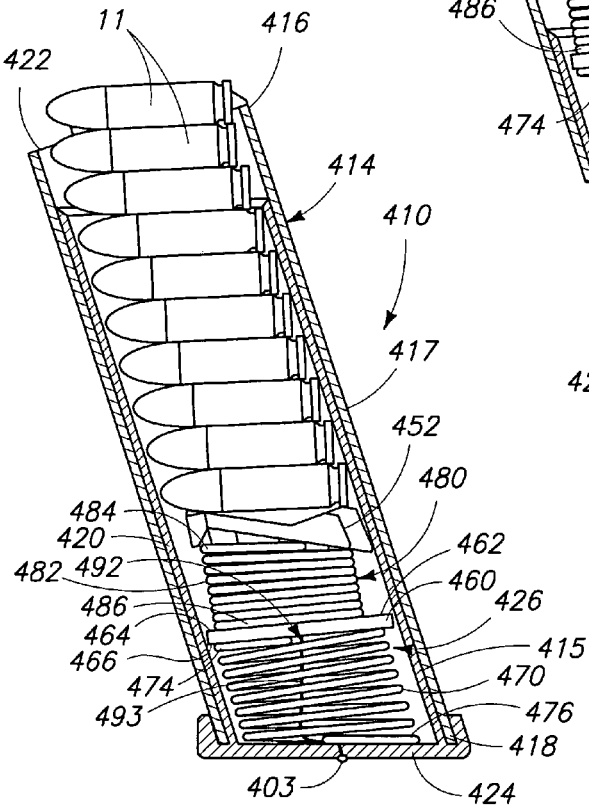
FIG. 25 is a vertical cross-sectional view similar to FIG. 24, showing the clip full of shells and the housing contracted to its feeding position.
Figure 27:
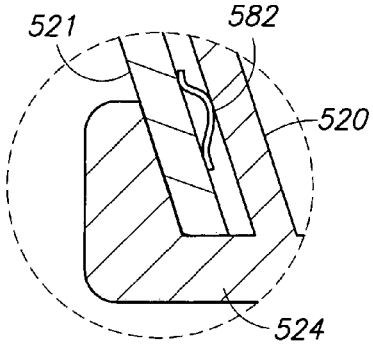
FIG. 27 is an enlarged, partial vertical cross-sectional view taken from the encircled region 27 of FIG. 26 further illustrating details of the one internal, frictionable spring clip.

Now the clip 410 is ready for insertion into the firearm 12. FIG. 25 shows the full clip 410 with the base 424 moved upward to the feeding position (and lower member 415 retracted into upper member 417) to further compress the chamber compression spring 470 and the coil compression spring 482 and urge the shells 11 into the firearm breech 16. Cable 493 is slack in FIG. 25, as clip 410 is presented in a feeding position. As previously illustrated in FIG. 15A, the arm hook 298 moves upward in the groove 300 and into the notch 18 to engage the latch of the firearm 12. The latch of the firearm 12 holds the arm hook 298 in the notch 18 and holds the clip in the firearm 12 until it is intentionally ejected.

FIGS. 26–30 illustrate yet even another embodiment for a cartridge clip 510, similar to the cartridge clip of FIGS. 10–14, and having a telescopic housing 514 including an inner telescoping member 515 and an outer telescoping member 517. Clip 510 has an elongated cartridge clip housing 514 that extends along a housing axis from an upper end 516 to a lower end 518. Inner member 515 and outer member 517 have inner and outer telescoping side walls 520 and 521, respectively. The housing 514 extends from a top cartridge opening 522 to a movable base 524 defining an interior telescoping cartridge shell storage chamber 526. When released, base 524 is movable between a feeding position, illustrated in FIG. 26, and a loading position, also illustrated in FIG. 26, as well as in FIGS. 28–30. Base 524 is integrally formed with the inner side walls 520 to expand the length of the housing 514 when the base 524 is moved while being loaded.

The clip 510 has a loading facilitating means 592 for facilitating the loading of live cartridge shells 11 into the storage chamber 526. The facilitating means 592 includes a releasable latching means 294 (see FIGS. 15A and 15B) for releasing the base 524 and inner side walls 520 to permit the chamber compression spring 570 to drive the base 524 and the inner side walls 520 from the feeding position, illustrated in FIG. 26, to the loading position, illustrated in FIGS. 26 and 28–30, and thereby expand the storage chamber 526 as shells are being loaded into clip 510. Load facilitating means 592 also includes a flexible wire cable 593 that limits the extension of spring 570. Cable 593 serves to limit extension of spring 570 particularly when in the loading positions of FIGS. 26 and 28–29 which enables extension of housing 514 as loading forces exceed frictional forces from a pair of leaf springs 582. Extension of housing 514 serves to reduce the loading force needed to compress seat 552 and load shells, as inner telescoping member 515 extends out from outer telescoping member 517.

Cooperation between single chamber compression spring 570 and the pair of leaf springs 582 serves to reduce forces needed when loading shells 11 into clip 510. More particularly, firearm cartridge clip 510 of FIG. 26 has an elongated clip housing 520 having side walls 526 that extend from an upper end 522 to a lower end 524 along a housing axis 534 encompassing and defining a cartridge shell storage chamber 536. The storage chamber 536 extends from an opening 542 at the upper end to a bottom base, or plate 548 at the lower end 524.

The clip 510 has a cartridge support seat 552 mounted in the storage chamber 536 for movement along the housing axis 534. The seat 552 has an elongated body 554 with an upper cartridge support surface 556. The clip 510 additionally has a load facilitating means 592 in the form of a lanyard, or cable 593 that restricts the distance between cartridge support seat 552 and base 524. Alternatively, a cord or rope can be substituted for cable 593. As seat 552 is driven in a downward direction due to loading of shells 11, spring 570 overcomes frictional forces from leaf springs 582 so as to drive lower member 515 downwardly, thereby telescopically extending housing 514. In this manner, spring 570 is not compressed as much as if housing 514 were a set length, which has the effect of reducing the loading force imparted by seat 552 and spring 570.

The clip 510 includes a chamber compression spring 570 mounted in the storage chamber 536 between the seat 552 and the base 524. The chamber compression spring 570 has spiral coils 572 extending to an upper end 516 engaging the lower surface of seat 552 and extending to a lower end 51 engaging the base 524. The chamber compression spring 570 has a known spring rate and is mounted in the storage chamber 526 in a pre-compressed condition so as to urge seat 552 upward.

The clip 510 further includes a movement restraining means 580 operatively connected to the cartridge support seat 552 for restraining the downward movement of the support seat 552 in the storage chamber 526. The movement restraining means 580 comprises a pair of leaf springs 582 each mounted on opposite inner surfaces of outer telescoping member 517. In one case, a hole is provided in an upper end of each leaf spring 582, and a plastic or metal rivet (not shown) is passed through the hole to secure the leaf spring 582 onto the inner surface of member 517. In another case, each leaf spring 582 is press-fit into a rectangular slot (or recess) within an inner surface of member 517 having a width with an interference fit that holds spring 582 therein. The upper end 584 of spring 570 engages the elongated body 554 and urges the support seat 552 upward. The lower end 586 of spring 570 engages the inner surface of base 524 and urges the inner telescoping member 515 downward when forces generated by loading shells and compressing spring 570 exceeds frictional forces created by leaf springs 582. The leaf springs 582 have a known spring rate that generates frictional forces that are less (weaker) than the spring forces created by spring 570. In this manner, loading forces are reduced over those of a traditional, non-telescoping clip.

More particularly, clip 510 has a loading facilitating means 592 for selectively rendering the chamber compression spring 570, at least partially, ineffective to substantially reduce the upward force exerted against the cartridge support seat 552. Such a force reduction materially reduces the physical effort required to sequentially load the clip 510 with cartridge shells.

Loading facilitating means 592 preferably includes an elongated cable 593 having an upper end operatively connected to the elevator element 560 by being molded into element 560 along with an enlargement similar to enlargement 503. Alternatively, cable 593 is secured to element 560 with a fastener, such as a rivet, a screw, or a swage fitting. The elongated cable 593 has a lower end that extends through a bore formed in base 548. Loading facilitating means 592 includes an enlargement or knot 503 formed on cable 593. The bore includes an enlarged portion larger than the bore and sized to receive enlargement 503 having a dimension sized larger than that of the bore. Alternatively, cable 593 is molded into base 524, or is secured with a fastener such as a rivet, a screw, or both. Further alternatively, an eyelet can be formed atop base 524, and cable 593 can be tied or swaged onto the eyelet.

Figure 26:
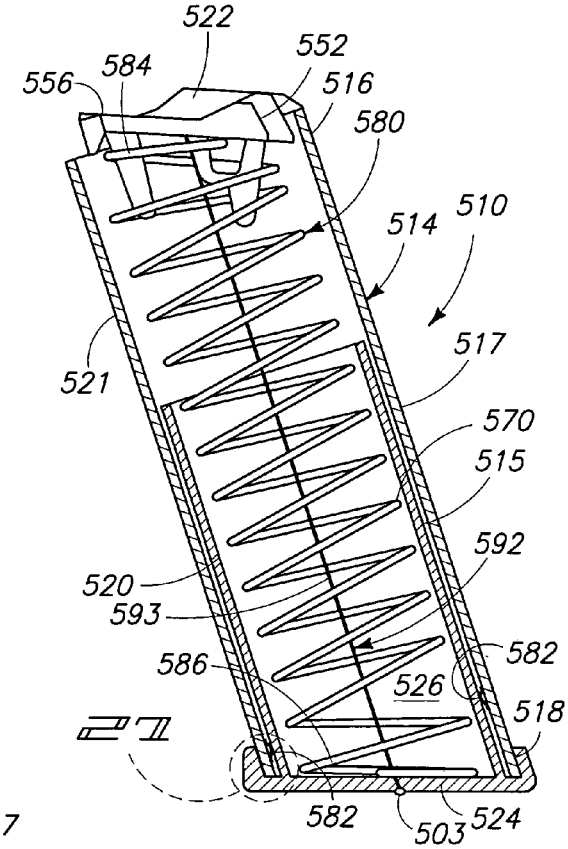
FIG. 26 is a vertical cross-sectional view similar to FIG. 22, except illustrating yet a further alternate embodiment of the clip in which the clip has a telescopic housing with internal, frictionable spring clips and in which the housing is shown in its contracted-empty position.

Cable 593 has an assembled length that maintains a maximum distance between seat 552 and base 524 corresponding with the respective positions when clip 510 is fully collapsed into the feeding position, as shown in FIG. 26.

The process for loading an empty clip 510 is illustrated in FIGS. 26–30. FIG. 26 illustrates an empty clip 510, with the seat 552 and inner telescoping member 515 in their uppermost positions.

To facilitate the loading of cartridge shells 11 into the storage chamber 526, the user activates the loading facilitating means 592 by releasing clip 510 from the breech of a gun. As discussed with previously described telescoping housings, this enables member 515 to telescope out from member 517. As this happens, cable 593 draws seat 552 downwardly within housing 514, maintaining a set distance between seat 552 and base 524. This action renders spring 570 less effective in exerting an upward force on the cartridge support seat 552. Such an upward force reduction substantially reduces the upward force applied by the compression spring 582 to the seat 552, as member 515 slides along leaf springs 582 (see FIG. 27), and thereby materially reduces the physical effort required to load the clip 510 with shells 11.

Figure 28:
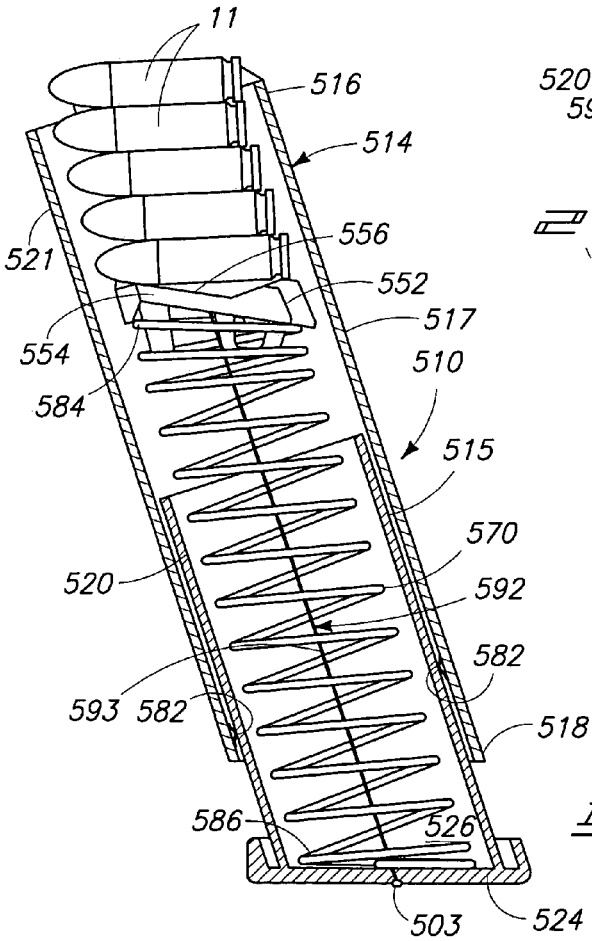
FIG. 28 is a vertical cross-sectional view similar to FIG. 26, except showing cartridge shells being loaded one at a time into the clip incrementally moving the cartridge support seat downward.
Figure 29:
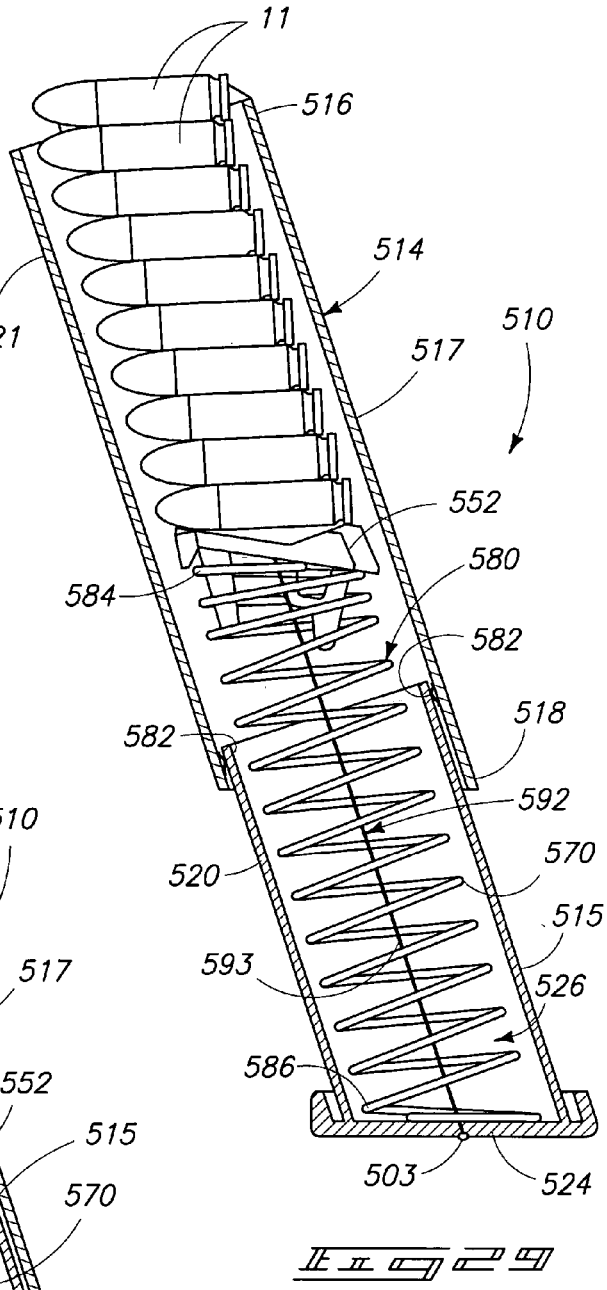
FIG. 29 is a vertical cross-sectional view similar to FIG. 28, except illustrating the clip completely full of cartridge shells, but with the telescopic housing fully extended.
Figure 30:
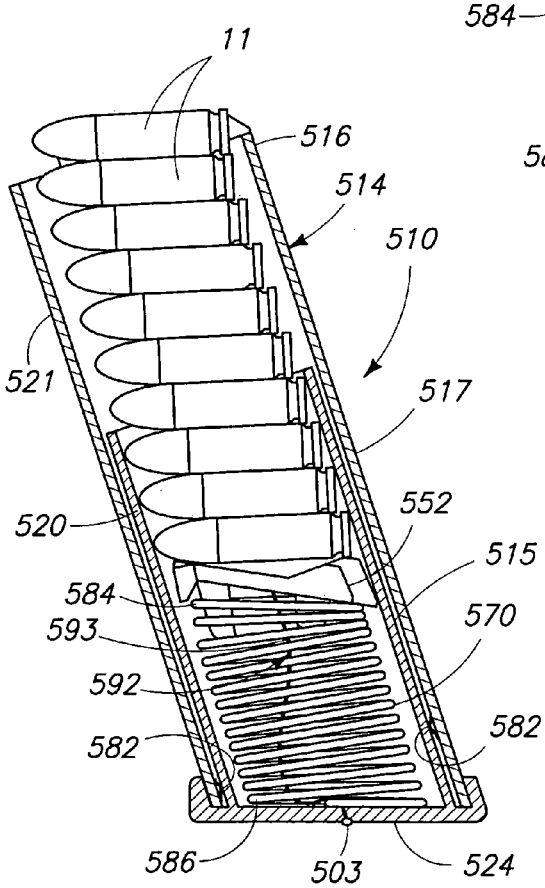
FIG. 30 is a vertical cross-sectional view similar to FIG. 29 showing a clip full of shells and the housing contracted to its feeding position.

After the lower member 515 is released from upper member 517 via the clip latch of the releasable latching means 294 (see FIGS. 15A and 15B), leaf springs 582 impart sufficient friction to maintain seat 552 in an elevated position that enables loading of shells 11 while reducing the compressive force needed to overcome spring 570. As spring 570 is compressed during loading, leaf springs 582 provide sliding friction between members 515 and 517 which is overcome to allow member 515 to lower as successive shells 11 are loaded into housing. FIGS. 28 and 29 illustrate progressive stages in the loading of cartridges shells 11 through the opening 542. FIG. 29 shows the clip 510 being fully loaded with cartridge shells 11. FIG. 30 shows clip 510 fully loaded and telescopically compressed, after being reinserted into a gun. Cable 593 is slack in this position. After the clip 510 is fully loaded, the releasable locking means 500 is overcome to render the chamber compression spring 570 again effective to urge the support seat 552 upward with force sufficient to load a gun with shells 11.

FIGS. 31–34 illustrate various components of a releasable latching means 694 (see FIGS. 32 and 34) that provide an alternative construction over releasable latching means 294 of FIGS. 15A and 15B. Such alternative construction can be used with the embodiments of FIGS. 10–14, FIGS. 22–25, and FIGS. 26–30 to latch and unlatch a telescoping housing. However, this alternative construction enables latching and unlatching when a clip is completely removed from a gun, in contrast to the embodiment of FIGS. 15A and 15B.

Figure 31:
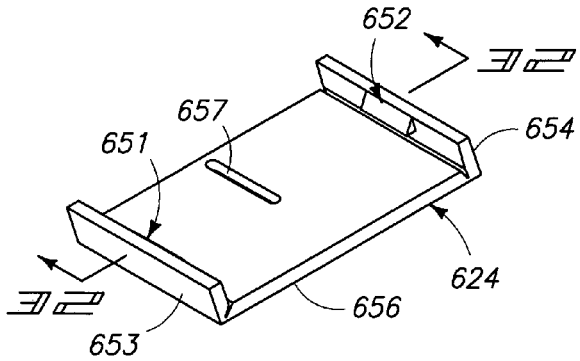
FIG. 31 is a perspective view of a movable base plate similar to FIG. 29, except illustrating an even further alternate embodiment of a clip in which the clip has a laterally movable base plate as further identified below with reference to FIGS. 32–34.

FIG. 31 illustrates a movable base plate 624 comprising an end wall 656 and a pair of opposed edge flanges 653 and 654. A clasp 651 and 652 is provided on each respective flange 653 and 654, at a central location. A slot 657 is provided centrally of end wall 656, extending from a center and laterally toward on side edge. Slot 657 provides a clearance fit for a rivet (or other fastener) 671 (see FIGS. 32 and 34) that secures base plate 624 onto a bottom of an inner telescoping member 615 of a clip 610. Rivet 671 is sized to allow lateral sliding of base plate 624 to lock inner member 615 in a telescopically inserted position within outer member 617, and to release member 615 from member 617 which enables telescopic extension of housing 614.

Figure 32:
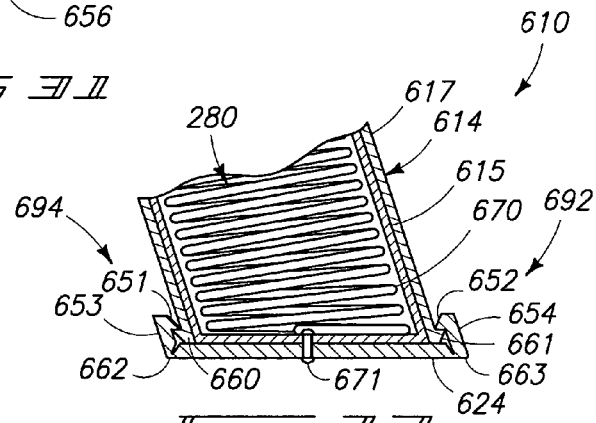
FIG. 32 is a vertical cross-sectional view similar to a portion of FIG. 26, except showing the clip full of shells and the end plate laterally positioned to hold the clip housing contracted to a feeding position.
Figure 33:
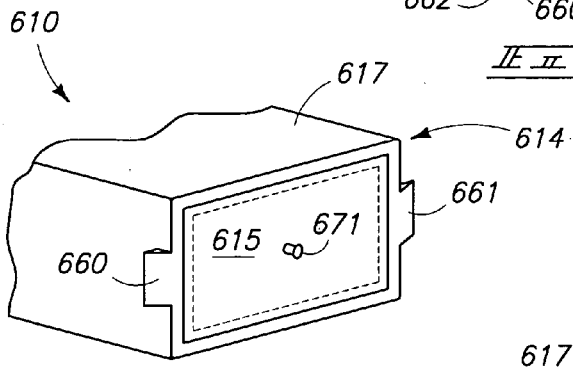
FIG. 33 is a partial detailed perspective view of an end portion of a base of the clip, but with the base plate removed, and illustrating details of complementary clips in the rivet that cooperate with the base plate to contract the housing to its feeding position and release the housing to a loading position.
Figure 34:
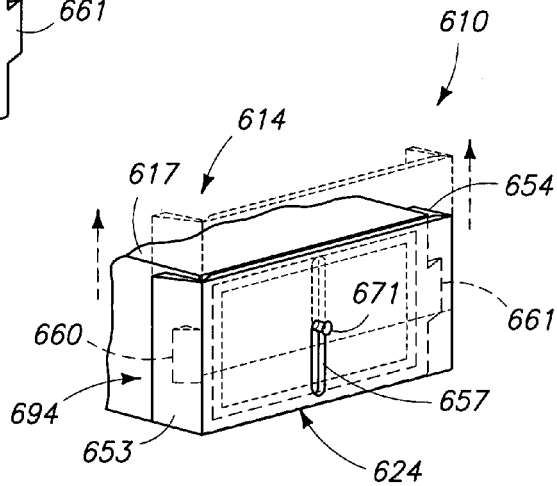
FIG. 34 is a partial detailed perspective view of a base of the clip including the base plate positioned in a locked position that holds the housing contracted in a feeding position, and showing in phantom, positioning of the base plate to release the housing to extend the housing into a loading position.

As shown in FIGS. 32 and 34, clip 610 is constructed similar to clip 510 of FIGS. 26–30, except for the addition of base plate 624. To facilitate locking and unlocking, outer member 517 has a pair of clasps 660 and 661 that interlock in mating, complementary engagement with clasps 651 and 652, respectively, when base plate 624 is centered over member 617. Clasps 660,661 and 651,652 each extend one-third of the lateral distance across base plate 624 and clip 610, and are positioned along a center. Such configuration provides for interlocking engagement between the clasps when base plate 624 is centered over the end of clip 610, but enables clearance between the clasps when base plate 624 is slid to a maximum laterally position (identified by dashed lines in FIG. 34). Accordingly, such movement releases the clip 610, and enables inner member 615 to telescope out from outer member 617 due to compressive action of spring 670.

As shown in FIG. 32, clasps 651, 652 and 660, 661 each have parallel contact surfaces where the clasps latch together, and have beveled contact surfaces where the clasps come into contact when retracting the telescoped housing 615. More particularly, contact between the beveled faces of clasps 651, 652 and 660, 661 causes edge flanges 653 and 654 to flex outwardly via plastic hinges 662 and 663, respectively. Flanges 653 and 654 flex sufficient to enable clasps 651, 652 to clear over clasps 660, 661, respectively, and engage in locked relation therebetween. Hence, base plate 624 is secured onto outer member 617 which locks housing 614 in a telescopically retracted position corresponding with a feeding position (when installed into a gun). Subsequently, the clip (in the retracted housing position) can be loaded into a gun while in the already retracted position. Lateral movement of base plate 624 provides for release and telescopic extension of the housing 614 to facilitate reduced-effort loading of shells into the clip 610.

According to one construction, the inner housing member, outer housing member, and base plate for each of the previously described embodiments are each constructed from plastic material such as Nylon™, high density polyethylene (HDPE), or a carbon-filled plastic material. Also according to one construction, the springs are constructed from spring steel.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A firearm cartridge clip, comprising:

a housing having a wall defining at least in part a chamber with a top end, a bottom end, and an opening at the top end, the chamber configured to store a sequential array of cartridge shells and the opening configured for loading shells and feeding shells to a firearm;

a cartridge support seat having a friction surface, the seat carried for movement in the chamber along a central axis of the housing and the friction surface configured to engage the wall and frictionally retain the seat in the chamber at a location that presents a top-most shell atop the seat adjacent a top end of the housing;

a spring provided between the cartridge support seat and the bottom end of the chamber configured to urge the cartridge support seat toward the opening; and a spring force-reducing structure provided between the seat and the housing and configured to counteract urging of the seat by the spring toward the opening.

2. The cartridge clip of claim 1 further comprising an elevator element movably mounted in the chamber intermediate the cartridge support seat and the spring for movement along a central axis of the housing.

3. The cartridge clip claim 2 wherein the elevator element frictionably engages with an inner wall surface of the chamber during movement of the elevator element along the central axis of the housing.

4. The cartridge clip of claim 1 wherein the spring force-reducing structure comprises a lanyard configured to move the seat towards the bottom of the housing to selectively lower the seat and compress the spring.

5. The cartridge clip of claim 4 further comprising an elevator element provided between the seat and the spring including a friction element engagable with an inner wall of the chamber that is overcome by the spring and the spring force-reducing structure to impart movement of the elevator element along a housing axis within the chamber.

6. The cartridge clip of claim 1 wherein the spring force-reducing structure comprises telescopic top and bottom portions of the housing, wherein the telescopic bottom portion is selectively movable between a truncated feeding position in which the spring is compressed and an extended telescopic loading position in which compression of the spring is reduced in order to reduce initial compression of the spring and thereby reduce manual effort required to load cartridges into the clip.

7. The cartridge clip of claim 6 wherein the spring force-reducing structure further comprises an elevator element provided beneath the spring and a chamber compression spring provided between the elevator element and the bottom portion of the housing, wherein the chamber compression spring has a higher spring stiffness than the spring.

8. The cartridge clip of claim 7 further comprising a lanyard configured to limit maximum extension of the chamber compression spring.

9. The cartridge clip of claim 6 further comprising at least one sliding friction spring interposed between the telescopic top and bottom portions of the housing.

10. The cartridge clip of claim 9 further comprising a lanyard configured to limit maximum extension of the chamber compression spring.

11. The cartridge clip of claim 6 further comprising a base plate movably supported by the housing and having at least one clasp that releasably engages between the telescopic top and bottom portions of the housing to secure together the top and bottom portions in a retracted configuration and release the top and bottom portions in a telescopically extended configuration.

12. In a firearm cartridge clip for receiving and storing a plurality of cartridge shells and for sequentially feeding such loaded cartridge shells to a breech of a firearm when a loaded cartridge clip is attached to the firearm, a cartridge clip housing having a cartridge shell storage chamber formed therein and defined at least in part by a wall, the housing extending longitudinally along a general housing axis between a bottom end and a top end, said top end having an opening through which the cartridge shells are (1) sequentially manually loaded into the storage chamber for storage, and (2) sequentially fed from the storage chamber into the firearm when the firearm cartridge clip is attached to the firearm;

a cartridge support seat having a friction surface configured to engage the wall and frictionally retain the seat in the chamber at a location that presents a top-most shell atop the seat adjacent a top end of the housing, the seat movably mounted in the storage chamber for (1) supporting the cartridge shells stacked one on top of another within the storage chamber substantially transverse to the housing axis, and (2) moving the cartridges along the housing axis;

an elevator element, separate from the cartridge support seat, that is movably mounted in the storage chamber intermediate the cartridge support seat and the bottom end for movement along the housing axis:

a chamber compression spring mounted in the housing chamber intermediate the elevator element and the bottom end having a known spring rate and an initial compression for normally urging the elevator element and the cartridge support seat toward the top end to sequentially feed cartridge shells to the top end opening; and loading facilitating means operatively connected to the chamber compression spring for selectively rendering the compression control spring at least partially ineffective to reduce the urging of the cartridge support seat toward the top end and thereby reduce the manual effort required to load the cartridge shells through the top opening and into the housing chamber.

13. In the firearm cartridge clip as defined in claim 12 wherein the loading facilitating means is operatively connected to the elevator for selectively lowering the elevator element against the chamber compression spring and thereby reduce the urging of the cartridge support shell toward the top end and facilitate the loading of cartridge shells into the cartridge shell storage chamber.

14. In the firearm cartridge clip as defined in claim 12 wherein the loading facilitating means includes lowering means connected to the elevator element for selectively lowering the elevator means and further compressing the chamber compression spring to render the chamber compression spring ineffective to urge the cartridge support seat upward toward the top end and thereby reduce the physical effort required to load cartridge shells through the top end opening and into the cartridge shell storage chamber.

15. In the firearm cartridge clip as defined in claim 14 wherein the lowering means is connected to the elevator element to selectively lower the elevator element relative to the cartridge support seat forming a storage volume in the cartridge shell storage chamber between the cartridge support seat and the elevator element and further comprising a movement restraining means operatively connected to the cartridge support seat for retraining the downward movement of the cartridge support seat when the elevator element is lowered.

16. In the firearm cartridge clip as defined in claim 15 wherein the movement restraining means includes a friction element associated with the cartridge support seat for preventing downward movement of the cartridge support seat until a manual effort downward force greater than the preset static friction of the friction element is applied to cartridge support seat.

17. In the firearm cartridge clip as defined in claim 16 wherein the friction element is mounted on the cartridge support seat and has friction surfaces that engage interior walls of the storage chamber to prevent the downward movement of the cartridge support seat until sufficient downward force is exerted on the cartridge support seat to load a cartridge shell through the chamber opening and into the storage chamber.

18. In the firearm cartridge clip as defined in claim 15 wherein the movement-restraining means includes a movement-restraining compression spring that is mounted within the cartridge shell storage chamber between the cartridge shell seat and the elevator element having an initial compression for urging the cartridge support seat toward the top end.

19. In the firearm cartridge clip as defined in claim 18 wherein the movement-restraining compression spring has a spring rate less than a spring rate of the chamber compression spring.

20. In the firearm cartridge clip as defined in claim 19 wherein the lowering means selectively lowers the elevator element relative to the cartridge support seat to reduce the initial compression of the movement-restraining spring and thereby reduce the manual effort required to load cartridges into the clip.

21. In the firearm cartridge clip as defined in claim 20 wherein the cartridge clip housing has an elongated main body with a telescopic bottom end that is selectively moveable between a truncated feeding position in which the chamber compression spring is compressed with the initial compression and an extended telescopic loading position in which the initial compression of the chamber compression spring is reduced to reduce the initial compression of the movement restraining compression spring and thereby reduce the manual effort required to load cartridges into the clip.

22. A firearm cartridge clip for receiving a plurality of cartridge shells and for sequentially feeding such loaded cartridge shells to a breech of a firearm when a loaded cartridge clip is attached to the firearm, comprising:

a cartridge clip housing having a cartridge shell storage chamber formed therein and define at least in part by a wall, the housing extending longitudinally along a general housing axis between a bottom end and a top end, the top end having an opening through which the cartridge shells are (1) sequentially loaded into the storage chamber for storage, and (2) sequentially fed from the storage chamber into the firearm when the firearm cartridge clip is attached to the firearm;

a cartridge support seat having a friction surface configured to engage the wall and frictionally retain the seat in the chamber at a location that presents a top-most shell atop the seat adjacent a top end of the housing, the seat movably mounted in the storage chamber for (1) supporting the cartridge shells stacked one on top of another within the storage chamber substantially transverse to the housing axis, and (2) moving the cartridges along the housing axis;

an elevator element movably mounted in the storage chamber intermediate the cartridge support seat and the bottom end for movement along the housing axis:

a first chamber compression spring mounted in the housing chamber intermediate the elevator element and the bottom end having a known spring rate and an initial compression for normally urging the elevator element and the cartridge support seat toward the top end to feed cartridge shells from the top opening;

a second chamber compression spring mounted in the housing chamber intermediate the cartridge support seat and the elevator element having a known spring rate and an initial compression for urging the cartridge support seat toward the top end, and loading facilitating means operatively connected to the elevator element for selectively lowering the elevator means toward the bottom end to reduce the urging of the cartridge support shell toward the top end and thereby selectively reduce the effort required to load the cartridge shells through the top opening and into the housing chamber.

23. The firearm cartridge clip as defined in claim 22 wherein the spring rate of the second chamber compression spring is less than the spring rate of the first chamber compression spring.

24. The firearm cartridge clip as defined in claim 22 wherein the loading facilitating means includes a telescopic means for lowering the bottom end of the housing to lengthen the cartridge shell storage chamber to lower the elevator element and the first and second compression springs to thereby reduce the compression of the second compression spring against the seat.

25. The firearm cartridge clip as defined in claim 24 wherein the load facilitating means includes a latching means for latching the base in a contracted feeding position and for releasing the base to move to an extended loading position.

26. The firearm cartridge clip as defined in claim 25 in which the latching means includes a release arm that extends upward from the base along the housing, said release arm having a hook at its outer end.

27. A firearm cartridge clip for receiving a plurality of cartridge shells and for sequentially feeding such loaded cartridge shells to a breech of a firearm when a loaded cartridge clip is attached to the firearm, comprising:

a cartridge clip housing having a cartridge shell storage chamber formed therein at least partially by a wall, the housing extending longitudinally along a general housing axis between a bottom end and a top end, the top end having an opening through which the cartridge shells are (1) sequentially manually loaded into the storage chamber for storage, and (2) sequentially fed from the storage chamber into the firearm when the firearm cartridge clip is attached to the firearm;

a cartridge support seat having a friction surface configured to engage the wall and frictionally retain the seat in the chamber at a location that presents a top-most shell atop the seat adjacent a top end of the housing, the seat movably mounted in the storage chamber for (1) supporting the cartridge shells stacked one on top of another within the storage chamber substantially transverse to the housing axis, and (2) moving the cartridges along the housing axis;

an elevator element movably mounted in the storage chamber intermediate the cartridge support seat and the bottom end for movement along the housing axis:

a chamber compression spring mounted in the housing chamber intermediate the elevator element and the bottom end having an initial compression for normally urging the elevator element and the cartridge support seat toward the top end to feed cartridge shells from the top opening;

a movement-restraining compression spring mounted in the housing chamber intermediate the cartridge support seat and the elevator element having an initial compression for urging the cartridge support seat toward the top end, and loading facilitating means operatively connected to the elevator element for selectively lowering the elevator means toward the bottom end to reduce the initial compression of the movement restraining compression spring and the urging of the cartridge support seat toward the top end and thereby selectively reduce the manual effort required to load the cartridge shells through the top opening and into the housing chamber.

28. The firearm cartridge clip as defined in claim 27 wherein the movement-restraining compression spring has a spring rate equal to or less than a spring rate of the chamber compression.

29. The firearm cartridge clip as defined in claim 28 wherein the loading facilitating means has a lowering means connected to the elevator element for selectively lowering the elevator element to reduce the initial compression of the movement-restraining compression spring to reduce the urging of the cartridge support seat toward the upper end to reduce the manual effort required to load cartridge shells into the clip.

30. The firearm cartridge clip as defined in claim 29 wherein the lowering means includes a cable having one end connected to the elevator element and an opposite end extending to the bottom end, in which the elevator element is selectively lowered against the chamber compression spring by the application of a pulling force on the opposite end of sufficient magnitude to overcome the initial compression of the chamber compression spring.

31. The firearm cartridge clip as defined in claim 29 wherein the loading facilitating means includes a cable holding means for holding the opposite cable end in a down position with the chamber compression spring substantially compressed to substantially reduce the initial compression of the movement-restraining compression spring.

32. The firearm cartridge clip as defined in claim 31 wherein the holding means includes (1) an enlarged stop affixed to the cable intermediate its ends, and (2) a narrow slot formed in the lower end of the housing for receiving the cable and for engaging the stop and preventing upward movement of the cable.

* * * * *